US010190376B2

(12) United States Patent
Machocki

(10) Patent No.: US 10,190,376 B2
(45) Date of Patent: Jan. 29, 2019

(54) APPARATUS AND METHOD FOR CONTROLLING A DOWNHOLE DEVICE

(71) Applicant: NXG Technologies Limited, Aberdeen (GB)

(72) Inventor: Krzysztof Machocki, Aberdeen (GB)

(73) Assignee: NXG Technologies Limited, Aberdeen (GB)

( * ) Notice: Subject to any disclaimer, the term of this patent is extended or adjusted under 35 U.S.C. 154(b) by 422 days.

(21) Appl. No.: 14/891,176

(22) PCT Filed: May 14, 2014

(86) PCT No.: PCT/GB2014/051476
§ 371 (c)(1),
(2) Date: Nov. 13, 2015

(87) PCT Pub. No.: WO2014/184551
PCT Pub. Date: Nov. 20, 2014

(65) Prior Publication Data

US 2016/0130897 A1 May 12, 2016

(30) Foreign Application Priority Data

May 16, 2013 (GB) ..... 1308861.2

(51) Int. Cl.
*E21B 23/04* (2006.01)
*E21B 29/00* (2006.01)
(Continued)

(52) U.S. Cl.
CPC ..... *E21B 23/04* (2013.01); *E21B 23/006* (2013.01); *E21B 29/00* (2013.01); *E21B 34/10* (2013.01)

(58) Field of Classification Search
CPC ..... E21B 23/006; E21B 23/04; E21B 29/00; E21B 34/10
See application file for complete search history.

(56) References Cited

U.S. PATENT DOCUMENTS 3,519,075 A * 7/1970 Mullins ..... E21B 34/125 166/150
4,913,231 A * 4/1990 Muller ..... E21B 23/006 166/187

(Continued)

FOREIGN PATENT DOCUMENTS

| | | | |
|---|---|---|---|
| EP | 0435856 | A2 | 7/1991 |
| WO | 98/31915 | A2 | 7/1998 |
| WO | 2013/079929 | A2 | 6/2013 |

OTHER PUBLICATIONS

PCT/GB2014/051476 IPRP and Written Opinion, dated Nov. 17, 2015.

*Primary Examiner* — Nicole Coy
(74) *Attorney, Agent, or Firm* — Dennis A. Bennett; Chris Marion

(57) ABSTRACT

Apparatus for controlling a downhole device in a well, comprises a body having a control slot engaging a pin. Movement of the pin relative to the control slot switches the device between active and inactive states. The slot has at least one loop and at least one elongated axial track spaced around the body with respect to the at least one loop. The pin can move in the at least one elongated axial track between different configurations of the pin and slot which correspond to active and inactive configurations of the downhole device. Each of the at least one elongated axial track is connected to one of the at least one loop via a deviate branch track, and the control slot has no separate, dedicate return path for returning the pin from the deviate branch track to the elongated axial track.

40 Claims, 22 Drawing Sheets

(51) Int. Cl.
*E21B 34/10* (2006.01)
*E21B 23/00* (2006.01)

(56) References Cited

U.S. PATENT DOCUMENTS

| | | | | |
|---|---|---|---|---|
| 5,020,592 | A * | 6/1991 | Muller | E21B 23/006 166/187 |
| 6,550,540 | B2 * | 4/2003 | Trent | E21B 23/006 166/134 |
| 2012/0199363 | A1 * | 8/2012 | Hu | E21B 10/322 166/373 |

* cited by examiner

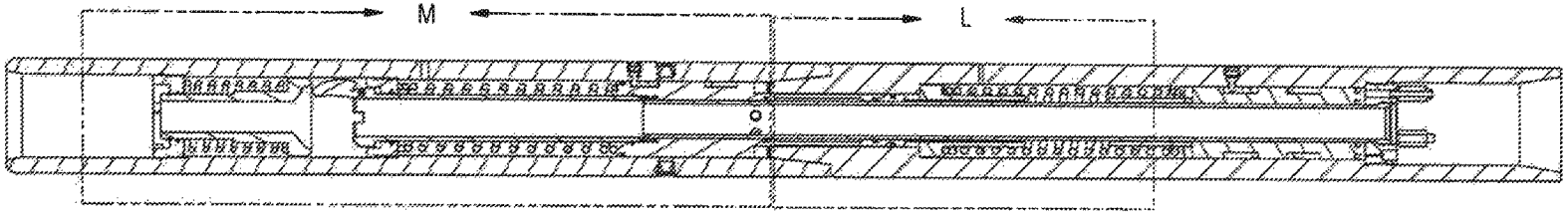
FIG. 42
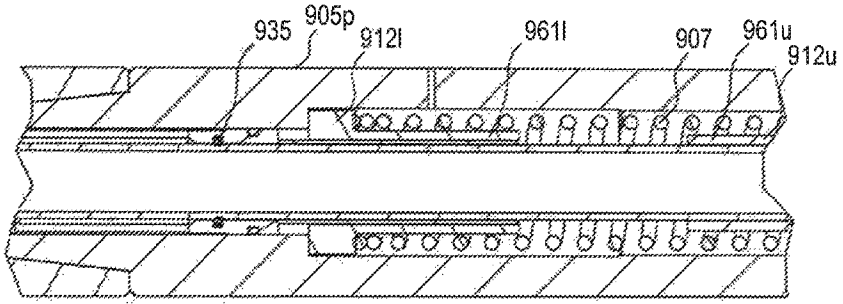
FIG. 42a (Detail L)
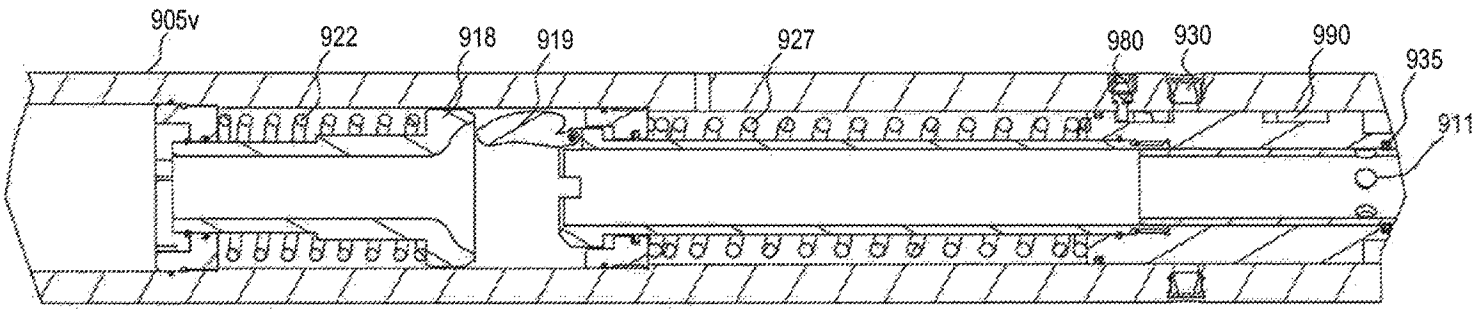
FIG. 42b (Detail M)

APPARATUS AND METHOD FOR CONTROLLING A DOWNHOLE DEVICE

The present invention relates to a method and apparatus for controlling downhole devices.

It is necessary to control the actions of downhole valves and other tools from the surface. Valves or other downhole tools frequently need to be opened and closed at different stages of drilling, operating and maintaining a wellbore, so controllers to achieve the remote opening and closing of the valve in the well are needed.

Activation and de-activation of downhole devices often involve steps such as dropping activation or deactivation balls from the surface. One disadvantage of these methods is that time between dropping the ball from the surface and the ball landing on the designated tool seat is a variable factor in the method. For very long wells it can take e.g. up to 40 minutes to switch a tool on and another 40 minutes to drop a second ball to switch the tool off. These methods also limit the number of on/off cycles that are possible because the number of balls that can be dropped and retained in the ball catcher is limited, and once the ball catcher is full, the tool must be retrieved to the surface and the ball catcher must be emptied before the tool can be re-set.

It is also well known to control tools in the well using pressure changes transmitted via fluid in the wellbore, which shuttles a sleeve axially relative to a pin. Such arrangements are typically called J-slot devices, as the sleeve is slotted with a J-shaped slot in which the pin moves. The sleeve is caused to rotate relative to the stationary pin which is constrained to travel along the J-shaped slot. When the pressure is increased, the sleeve moves down, the pin is at one position in the slot, and the valve is open for example, and when the pressure is decreased, the sleeve moves up relative to the pin, which is guided into another relative position of the pin and the slot, in which the valve can be closed. The slot can be formed in a loop around the sleeve, with the two ends of the loop connected, so that the sleeve continually moves around its axis sequentially opening and closing the valve. The pressure acting on the sleeve can be wellbore pressure or can be control line pressure.

SUMMARY OF THE INVENTION

According to the present invention there is provided an apparatus for controlling a downhole device in an oil, gas or water well as claimed in independent claim 1.

According to the present invention there is also provided an apparatus for controlling a downhole device in an oil, gas or water well as claimed in independent claim 20.

The invention also provides a method of controlling a downhole device in an oil, gas or water well as claimed in independent claim 27.

The invention also provides a further method of controlling a downhole device in an oil, gas or water well as claimed in independent claim 39.

Typically the pin can remain in one of the loops without moving into an adjacent elongated axial track, moving between different configurations of the pin and slot within each loop. Typically the pin cycles repeatedly between the two different configurations of the pin and slot within each loop, moving repeatedly from one to the other until switched from one of the loops to an adjacent elongated axial track. Typically the pin cycles from the origin of each of the loops to a second position in the loop and back to the origin of the same loop. The loops can be connected to further loops or tracks that may have the same or different functions. Accordingly such further loops may optionally allow cycling in the same way, but provided that the first and second loops allow cycling, it is not necessary for other loops or tracks to do so.

Typically the geometry of the slot restrains the movement of the pin within one of the loops until switched.

Typically each of the loops comprises a first track and a second track, wherein the second track returns the pin to the starting point of the first track. Typically the pin normally moves in opposite axial directions in the two tracks. Typically the pin can be switched from one of the loops to an adjacent elongated axial track on the second return track. Typically the switching is achieved by reversing the relative axial direction of movement of the pin and slot, typically by reversing the axial direction of movement of a sleeve in which the slot is formed. Typically the switching is accomplished when the pin is in a transition portion of the second return track, typically having passed a junction (typically a Y-junction) leading to the adjacent elongated axial track. Typically the y-junction is inverted, and the switching from a loop to an adjacent elongated axial track is accomplished when the pin moves into the upper limb of the y leading towards the elongated axial track. Typically the one limb of the y is a part of the loop and the other limb of the y is a deviate track linked to the adjacent elongated axial track. Typically one of the limbs (e.g. the limb connected to the adjacent elongated axial track) is in axial alignment with the trunk of the y.

Typically the body comprises a piston responsive to pressure changes in the well, and axially movable in a bore in the apparatus in response to said pressure changes. Typically the axial movement of the piston in the bore drives the relative movement of the pin and the slot.

Typically the slot can be provided on a sleeve that moves relative to the body, and the pin can be provided on the body, but in other embodiments, the sleeve can have the pin and the slot can be provided on the body. The sleeve can typically be formed integrally with the piston. Thus the piston can optionally bear the slot, or it can be formed on a separate sleeve that is connected to the piston.

Typically the start and end of the first and second tracks, where the pin switches between the two tracks, are spaced apart axially along the sleeve/piston and/or they can optionally be spaced circumferentially, but in certain embodiments the start and end of the first and second tracks in each loop can be axially aligned along the axis of the body. The end point of each track, corresponding to the start point of the other track, is typically formed at a corner of the slot, which guides the change in the direction of movement of the pin relative to the slot, typically forming a stop that requires reversal of the axial direction of movement of the pin relative to the slot. For example, the first track can start at one end of the sleeve or piston, e.g. the lower end, and can extend axially up the sleeve/piston (typically with a lateral or circumferential component in addition to the axial component) to the end of the first track provided in the form of an inverted V at a position that is axially spaced apart on the sleeve/piston from the starting position of the first track, e.g. at or near to the top of the sleeve/piston. The inverted V marks the transition between the first and second tracks. From the apex of the inverted V, the pin is constrained to move down the second track.

Typically the first and second tracks have first portions that are typically linear (e.g. axial) and are typically arranged parallel to the axis (e.g. the axis of the body or sleeve and piston), and which do not drive relative rotation of the pin and slot components; and second portions, which typically also incorporate straight lengths but can also be deviated away from the first portion, and so typically extend axially and circumferentially, thereby driving rotation of the pin and slot components (typically driving the sleeve/piston relative to the stationary pin) in accordance with the angle of the deviation of the second track in relation to the axis. In some embodiments, both the first linear and second deviated portions can optionally be angled with respect to the main axis of the piston/sleeve. Such embodiments can optionally have deviated portions also, but typically the second deviated portions are set at a greater angle than the first linear portions to drive a greater rotation of the sleeve than the linear portions. Typically where the whole slot is angled (to a greater or lesser extent) then the movement of the pin through the slot will drive continued rotation of the piston around its axis, and the extent of rotation will typically vary in accordance with the angle of the linear and deviated portions of the slot with respect to the axis.

Typically the switching is accomplished when the pin is in a transition portion of the second return track. The transition portion of the second return track is typically an axial portion. Typically the switching is triggered by reversal of the direction of movement of the pin in the axial portion of the slot. Typically the axial transition portion is adjacent to the Y-junction in the slot, between a loop and an adjacent elongated axial track, and typically the reversal of the movement of the pin in the transition portion of the slot causes the pin to move from one loop to an adjacent elongated axial track.

Typically the slots comprise spaced apart end portions, each having blind ended tracks (typically extending axially) and deviated portions that typically deviate from the axis of the apparatus and axial transition portions.

Typically the apparatus comprises alternating loops and elongated axial tracks spaced circumferentially around the sleeve/piston. Normally the loops and the elongated axial tracks are arranged in pairs with one loop and its adjacent elongated axial track in each pair. Simple embodiments of the invention can comprise merely one loop and one elongated axial track, and the pin can transition between them, idling in the loop, and switching to an active position in the elongated axial track. However, in other embodiments of the invention, it is possible to have multiple pairs of loop and elongated axial track, optionally alternating in a sequence (e.g. loop-elongated track-loop . . . etc.) around the circumference of the sleeve or piston. Thus in such embodiments, the pin can idle in a first loop, switch to an adjacent elongated axial track where it can move the device to an active position, and then move into another (optionally a different) loop to idle once more before being switched into a (optionally different) second elongated axial track. 2, 3, 4 or more pairs of loop and elongated tracks can optionally be provided in some embodiments. The different loops can optionally have the same or different characteristics but typically they all have the same characteristics of idling between different positions of the sleeve/piston without activating the device. Likewise the different elongated axial tracks can have the same or different characteristics, and optionally more variation in characteristics can be seen in different elongated axial tracks, as these can, in some embodiments of the invention, be configured to switch between different active states of the device, for example, one second loop can switch between closed and 50% open, and another second loop can switch between closed and 75% open, etc.

Typically the speed of movement of the pin in the first track is different from the speed of the pin in the second return track, typically in each loop. Typically the pin moves more slowly in the second track of the slot than in the first track. The movement of the pin through the first track is typically as quick as possible. However, the movement of the pin through the second (return) track is optionally deliberately slowed in order to provide a larger time window for triggering reversal of the direction of movement of the pin in the second track of the slot. This provides more time to trigger the transition between the two loops, which can then be accomplished more easily and more accurately, and typically using conventional surface apparatus, such as surface pumps. Typically the difference in speed between the two tracks can be controlled by hydraulic means, for example, by providing different fluid pathways for flow of fluid when moving the pin in the respective first and second tracks. For example, the pin can move more slowly in the second track than in the first because the fluid forcing movement of the pin in the second track can have a flow restrictor in the fluid pathway, whereas the fluid driving the pin through the first track can optionally typically move through higher capacity pathways with less resistance to fluid flow. Optionally the fluid flow pathways in each of the first and second tracks can be structurally the same, and the speed differential is controlled by functional steps, for example, applying different pressures during passage of the pin through each of the tracks, to move the pin more slowly through the second track than through the first.

Optionally, different portions (e.g. the deviated and axial portions) of the second track have different characteristics concerning the maximum possible speed of movement of the pin in those portions, and in typical embodiments of the invention, the pin can optionally move more quickly through at least one of the deviated portions of the second track than through the axial portion. Therefore, these differential limits on speed of movement of the pin through the slot permit the quick movement of the pin to the point at which transition occurs from a loop to its adjacent elongated axial track, and then a controlled, slower movement through the transition zone of the slot allowing more time (e.g. several minutes) to trigger changes from surface in order to switch the pin from a loop to its adjacent elongated axial track, optionally followed by a quicker movement back to the starting point of the first track after the pin has passed the transition point at which switching between loops is possible.

Optionally the speed restrictors are fluid flow restrictors where the driving force moving the pin through the slot is hydraulic, but in other embodiments where the motive force for the movement of the pin through the slot is something else, then the speed restrictors can comprise other suitable components.

Optionally the apparatus is used to operate a valve, for example to move a sleeve/piston in order to open or close one or more ports to allow or restrict or choke fluid flow, for example in a circulation valve. Optionally the apparatus is used to operate a cutting tool, for example to move a sleeve/piston in order to cause a cutting element to extend from a body of the tool, for example in a reaming tool such as an under-reamer. The loops can be set up to allow the operator to circulate fluid though the tool without expanding cutters while in the loops. The first elongated axial tracks can be configured to move between unexpanded and partially expanded cutter positions e.g. 50% expanded, and the second elongated axial tracks can be configured to move between unexpanded and a different configuration e.g. 100% expanded. Embodiments of the apparatus can also be used to extend and recover the blades of stabilisers. Many other uses of the apparatus are possible.

It is particularly beneficial that the apparatus allows cycling between different idling configurations without necessarily activating the tool it is controlling. This allows operation of other pressure-activated tools in the string independently of the apparatus controlled by embodiments of the invention. Also, it permits a string incorporating apparatus of the invention to be broken and made up at the surface to add or remove stands of pipe to the string without affecting the configuration of the device, for example, without switching the device between inactive, partially or fully active configurations, until the pin is switched between the first and second loops at the desired time selected and controlled by the operator.

Typically the apparatus comprises a conduit passing through a body, allowing passage of fluid through the conduit past the apparatus. Optionally the body bore can be aligned with the bore of a string in which the apparatus is incorporated.

Typically the piston can be moved by fluid pressure in the bore of the body. Typically the bore allows transmission of the fluid pressure past the apparatus in the string in order to activate other tools in the string.

Optionally the sleeve/piston can be biased by a resilient device, such as a spring, e.g. a coiled spring, in one axial direction, and the fluid pressure (or other motive force driving the movement of the pin in the slot) can act in the opposite direction, against the force of the resilient device. Therefore, the sleeve/piston can typically be biased in one direction, e.g. upwardly, and the apparatus can optionally be activated by applying fluid pressure (or other motive force) to move the sleeve/piston down against the force of the resilient device.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one embodiment can typically be combined alone or together with other features in different embodiments of the invention.

Various embodiments and aspects of the invention will now be described in detail with reference to the accompanying figures. Still other aspects, features, and advantages of the present invention are readily apparent from the entire description thereof, including the figures, which illustrates a number of exemplary embodiments and aspects and implementations. The invention is also capable of other and different embodiments and aspects, and its several details can be modified in various respects, all without departing from the spirit and scope of the present invention. Accordingly, the drawings and descriptions are to be regarded as illustrative in nature, and not as restrictive. Furthermore, the terminology and phraseology used herein is solely used for descriptive purposes and should not be construed as limiting in scope. Language such as "including", "comprising", "having", "containing" or "involving", and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including", or is preceding the recitation of the composition, element or group of elements and vice versa.

All numerical values in this disclosure are understood as being modified by "about". All singular forms of elements, or any other components described herein are understood to include plural forms thereof and vice versa.

Figure 30A:
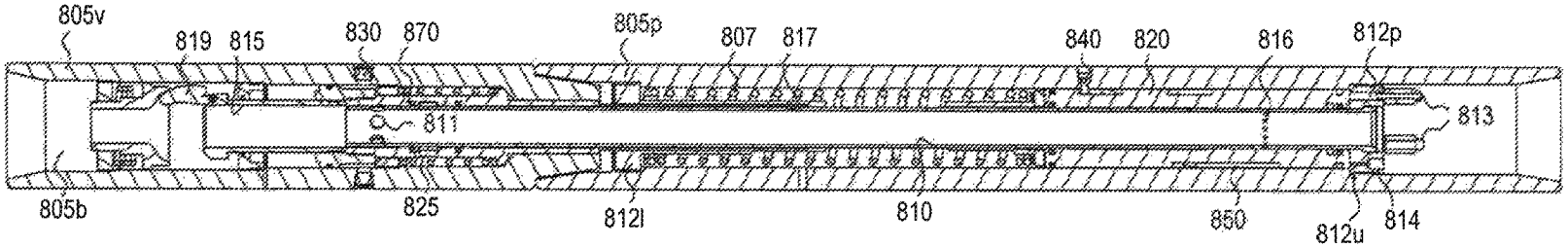
Figure 30B:
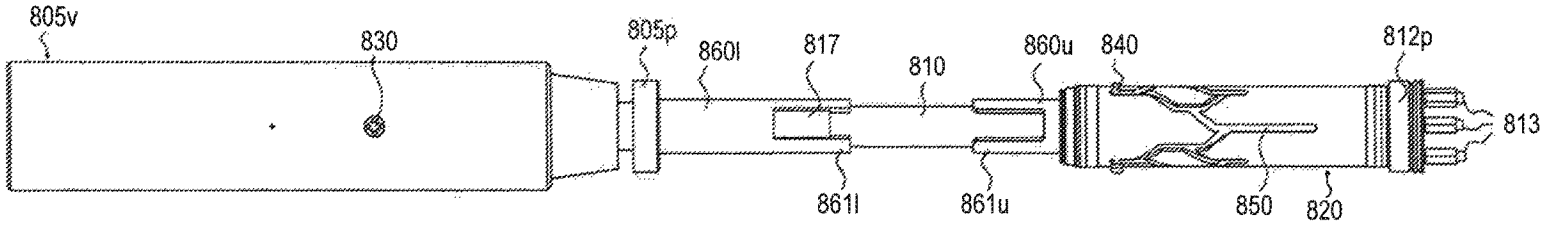
Figure 31A:
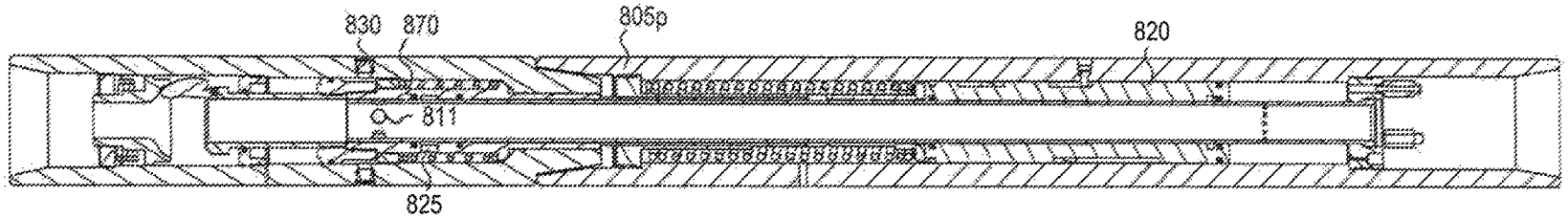
Figure 32A:
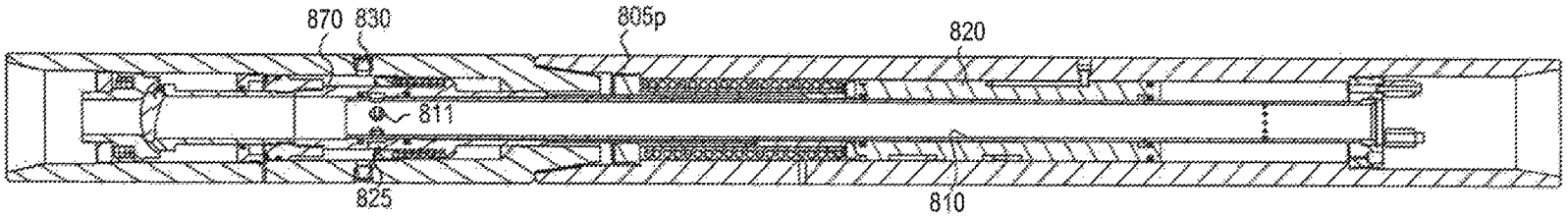
Figure 33A:
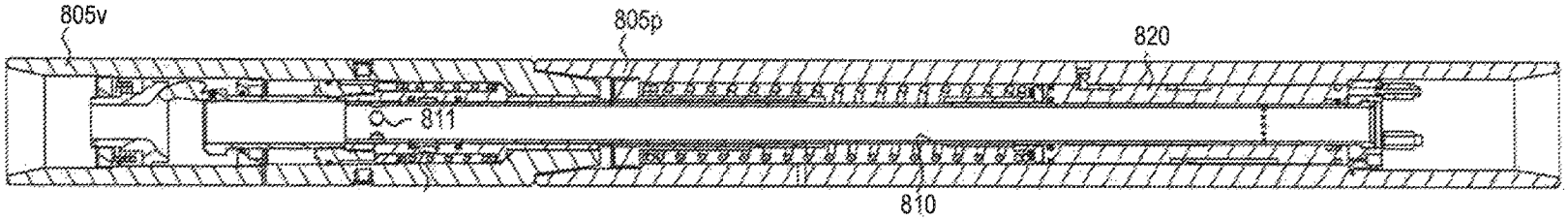
Figure 34:
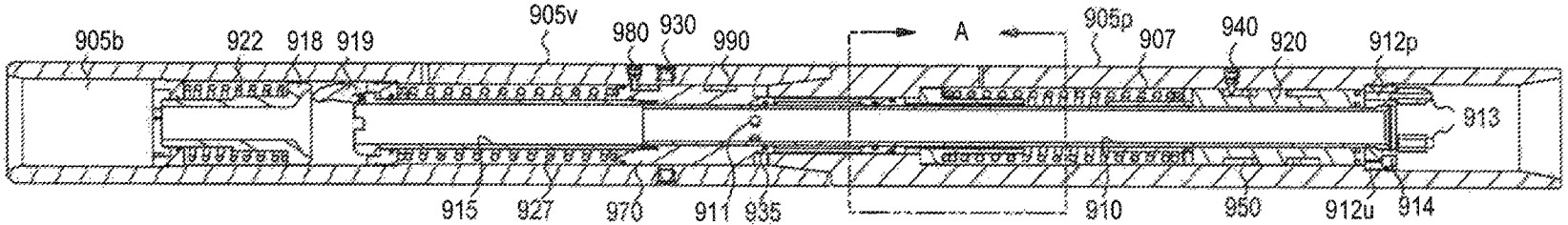
Figure 34A:
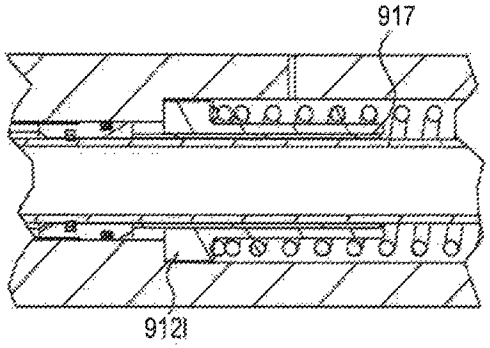

FIGS. 30*a* and *b* show a further example of a tool in section and partial side view in a first inactive configuration with no pressure applied to it and the pin in the (inactive) loop;

FIGS. 31*a* and *b* show similar views of the FIG. 30 tool in a second inactive configuration under pressure, with the pin in a first loop;

FIGS. 32*a* and *b* show similar views of the FIG. 30 tool in a first active configuration, where the tool is under pressure and the pin is in the elongated axial track; and FIGS. 33*a* and *b* show similar views where the tool is not under pressure, and the pin is in a second loop;

FIG. 34 shows a further embodiment of a tool in section and partial side view in a first inactive configuration with no pressure applied to it, a primary control pin in the (inactive) loop and a secondary control pin in an inactive position;

FIG. 34*a* shows an enlarged view of part A of the FIG. 34 tool.

Figure 35:
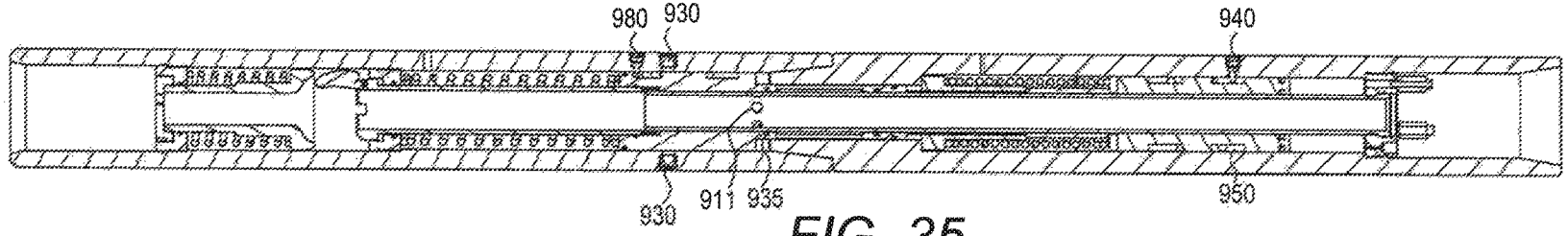
Figure 36:
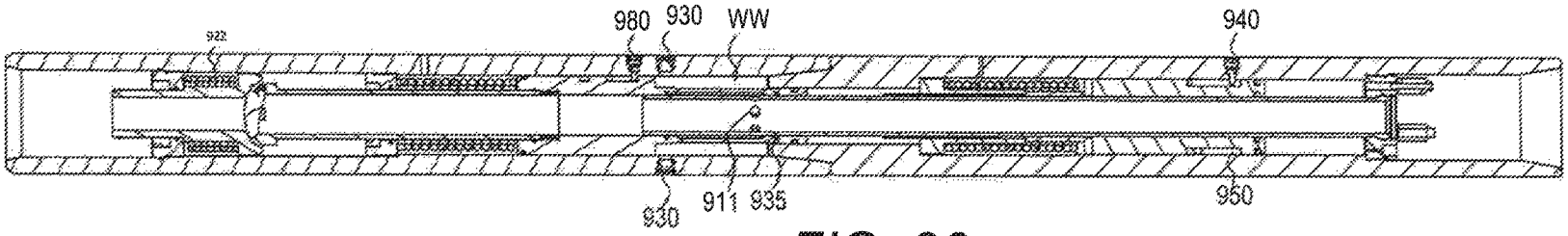
Figure 37:
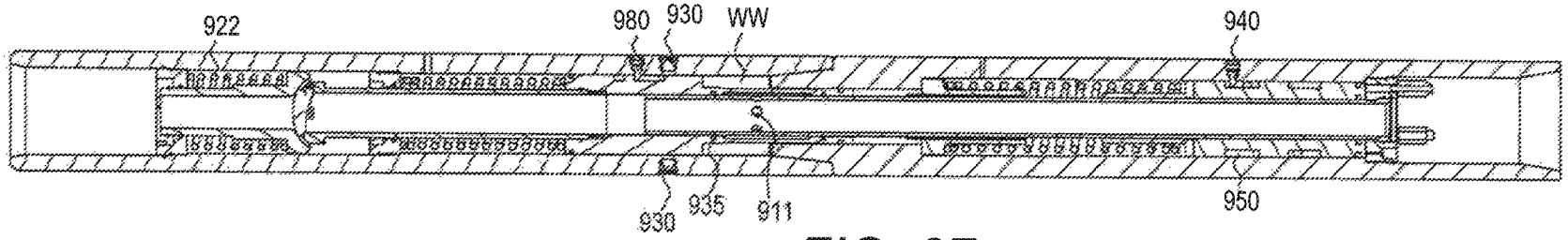
Figure 38:
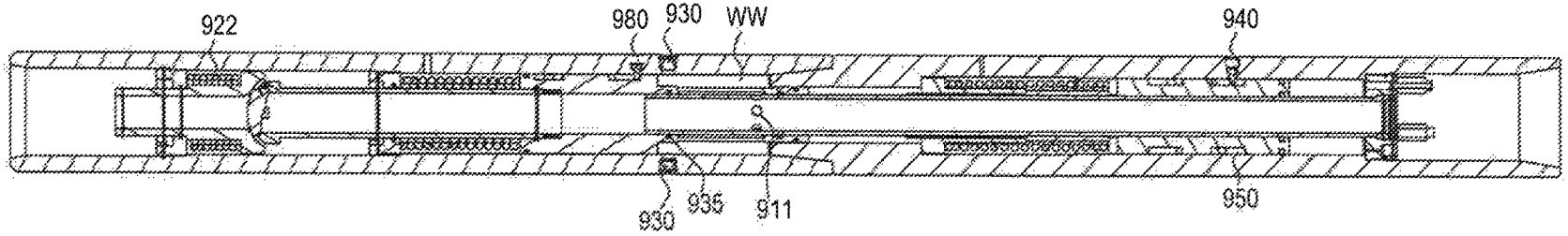
Figure 39:
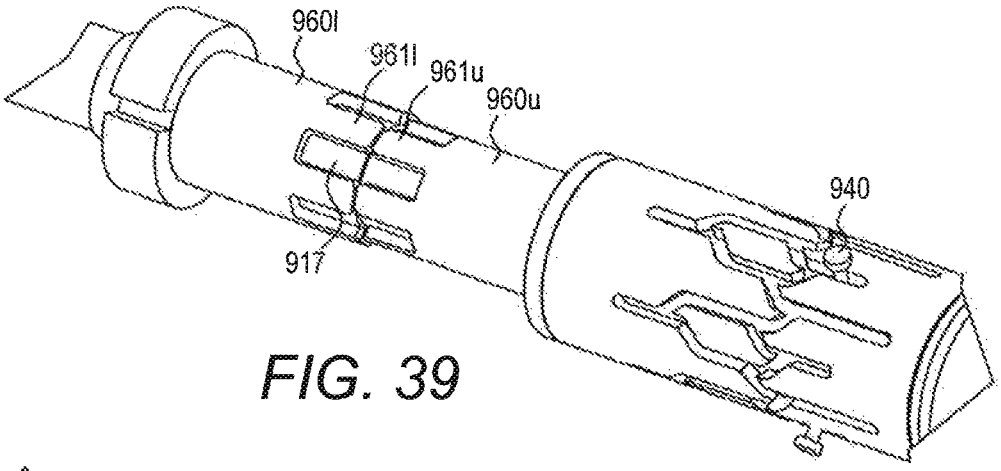
Figure 40:
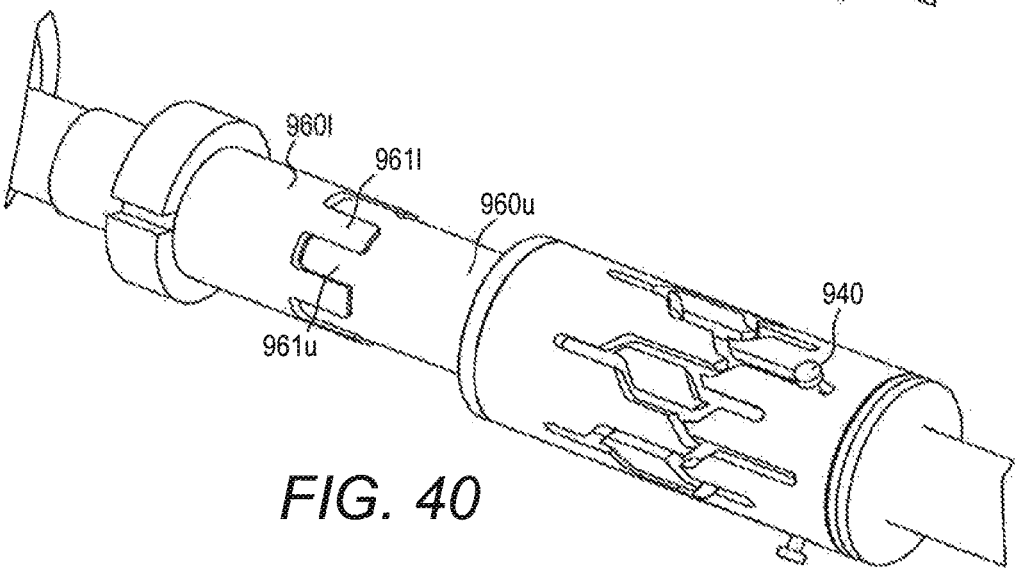
Figure 41:
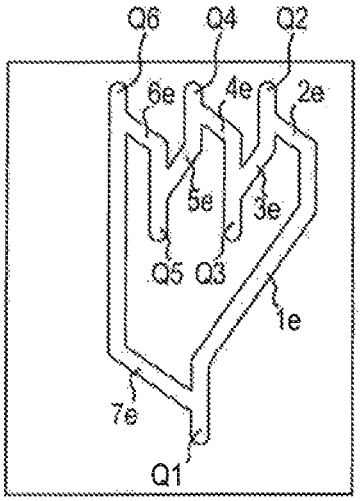

FIG. 35 shows a similar view of the FIG. 34 tool in section and partial side view in a second inactive configuration under pressure;

FIG. 36 shows a similar view of the FIG. 34 tool where the tool is under pressure, the primary control pin is in the elongated axial track and the secondary control pin is in a first inactive position;

FIG. 37 shows a similar view of the FIG. 34 tool where the primary control pin is in the loop and the secondary control pin is in a semi-open position;

FIG. 38 shows a similar view of the FIG. 34 tool where the primary control pin is in the loop and the secondary control pin is in a second active position;

FIGS. 39 and 40 show side views of inner components of the tool in different configurations;

FIG. 41 is a schematic plan view of the slot on the valve piston 970 in the FIGS. 34-40 tool, as if the surface of the piston were unrolled into a flat plane;

FIGS. 42, 42*a* and 42*b* show enlarged sectional and partial side view of the FIG. 34 tool.

Figure 1:
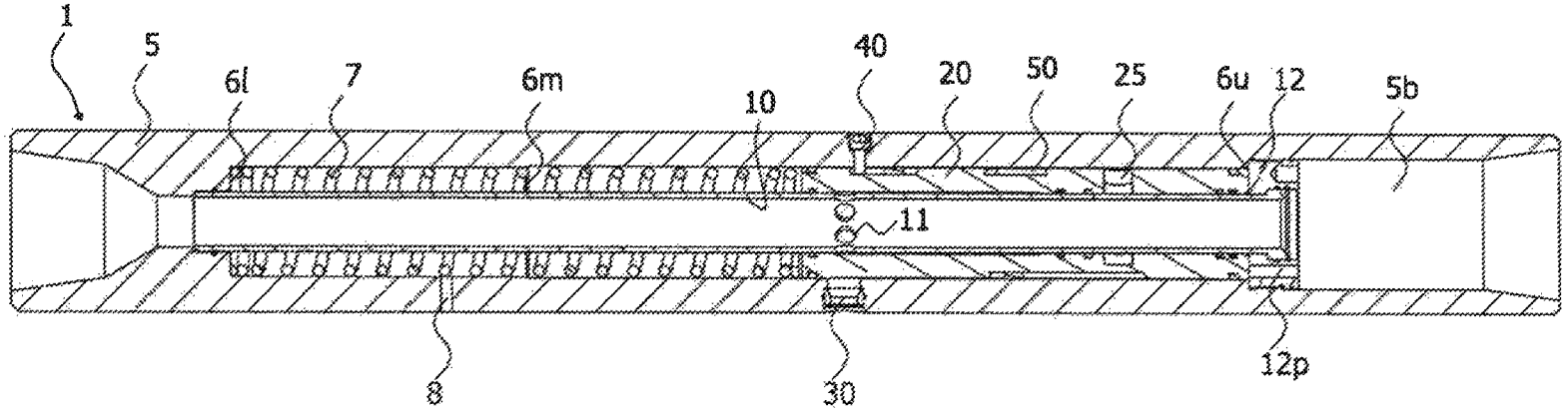
FIG. 1 is a side sectional view of a first circulation tool incorporating apparatus according to the invention, in a first closed configuration in which the pin is in a first loop, and the circulation tool is closed.

Referring now to the drawings, FIG. 1 shows a first example of apparatus for controlling a downhole tool in accordance with the invention, in cross-section view. The apparatus of FIG. 1 comprises a control sub 1 with a body 5 having box and pin connections at respective ends adapted to connect the body 5 into a string of an oil or gas well. The string can typically comprise a number of tubular devices connected end to end above and below the control apparatus 1. As shown in the Figures, in this example, the apparatus 1 is connected in the string so that the left hand end of the body 5 is furthest down the hole, and the right hand side of the body 5 is nearer the surface, but different arrangements can be adopted in other examples. The body 5 has a central bore 513 having three upwardly facing shoulders, a first shoulder 6*u* adjacent an upper end, and a second shoulder 61 adjacent a lower end, and a smaller middle shoulder 6*m*. The bore 513 passes between the two ends of the body 5 allowing passage of fluid through the body 5. A flow tube 10 extends axially through the body 5, being co-axial with the main axis of the bore 5*b*, and having a restricted inner diameter, similar to the inner diameter of the bore 513 below the lower step 6*l*. The flow tube is sealed on its outer surface at the bottom of the flow tube 10, and is typically screwed and sealed into an internal thread in the throat of the bore 513 below the lower step 6*l*, and at its upper end, is held in place by a collet or circlip that engages a collar 12, which typically screws into an internal thread on the inner surface of the larger diameter section of the bore 513 above the first step 6*u*. Therefore, the flow tube 10 is typically secured co-axially in the bore 5*b*. Instead of screw threads, the flow tube 10 can optionally be connected in the inner bore by means of a collet or circlip arrangement. In this example, the flow tube 10 is typically screwed mechanically in the body 5 only at the bottom and is retained at the top by the collar 12, but alternatively it could be retained by a screw thread or a collet at each or either end.

The flow tube 10 defines an annulus between the outer surface of the flow tube 10 and the inner surface of the bore 5*b* within the body 5. Within the annulus, a spring 7 is provided in the lower part of the tool. The spring 7 bottoms out on the upwardly facing surface of the lower step 6*l*. Typically, the spring 7 is held in compression by a piston 20 set within the annulus above the spring 7, and surrounding the upper part of the flow tube 10. The compression of the spring 7 between the upwardly facing surface of the lower step 6*l* and the downward facing surface of the piston 20 pushes the piston 20 upwards within the annular space, compressing it against the lower face of the collar 12. The force of the spring 7 is typically chosen to be relatively weak in its expanded configuration shown in FIG. 1, and the spring force is designed to allow fluid pressure in the annulus above the piston 20 to overcome the force of the spring 7 and allow the piston 20 to move axially within the annulus, as will be described below. The piston 20 is typically sealed on its inner and outer faces, to ensure that it moves with the force of fluid within the annulus, preventing passage of fluids. Sliding movement of the piston within the annulus to compress the spring typically exhausts fluid below the piston through an exhaust vent 8, which helps to avoid piston lock.

The body has a number of circumferentially spaced circulation ports 30, which are arranged at the same axial position, but at different circumferential positions around the body 5. These are aligned axially with ports 11 passing through the wall of the flow tube 10. The circulation ports 30 extend through the wall of the body 5, and allow fluid communication between the bore 5*b* of the body, and the outer surface of the body 5 in certain circumstances. However, in the position shown in FIG. 1, the inner surface of the ports 30 (and the outer surface of the ports 11) is occluded by the piston 20 which is sealed above and below the axial position of the ports 11, 30, thereby preventing fluid communication between the bore 5*b* and the outside of the body when the piston 20 is in the position shown in FIG. 1.

The piston 20 has a set of circumferentially spaced ports 25, which have the same circumferential spacing as the circulation ports 30 in the body 5. The flow tube 10 also has a number of ports 11 spaced around its circumference. In other examples, the circumferential spacing pattern of the ports 11 in the flow tube 10 can be the same or different to the spacing pattern of the ports 30 in the body 5. In this example, the ports 11 are aligned with the ports 30. However, the axial position of the ports 11 in the flow tube 10 is such that the ports 25 in the piston 20 only align axially with the ports 11 when the lower face of piston 20 bottoms out on the shoulder 6*m*. The ports 25 on the piston 20 are similarly arranged at a common axial location on the piston. Movement of the piston 20 to slide down the bore 5*b* to compress the springs therefore brings the ports 25 in the piston 20 into axial alignment with the ports 30 in the body 5, and with the ports 11 through the flow tube 10, which opens the flow path for communication of fluid between the bore 5*b* of the body 5, and the outside surface of the body.

Figure 8:
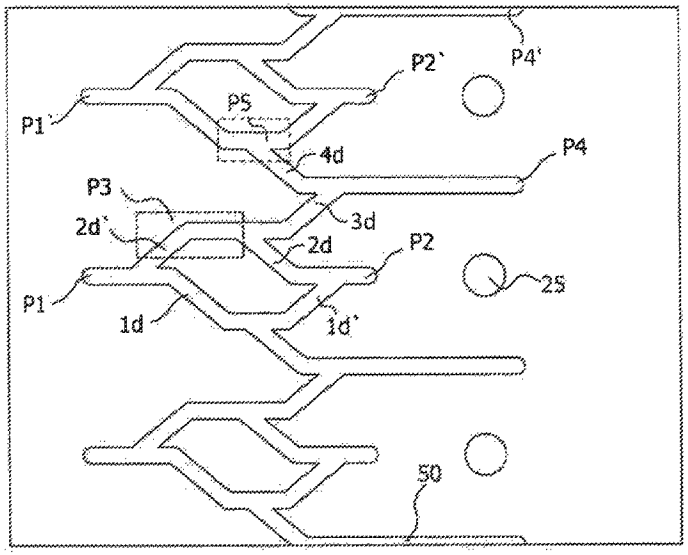
FIG. 8 is a schematic plan view of the slot of the FIG. 1 apparatus, as if the surface of the piston were split axially along the line A-A of FIG. 9 and unrolled into a flat plane.
Figure 10:
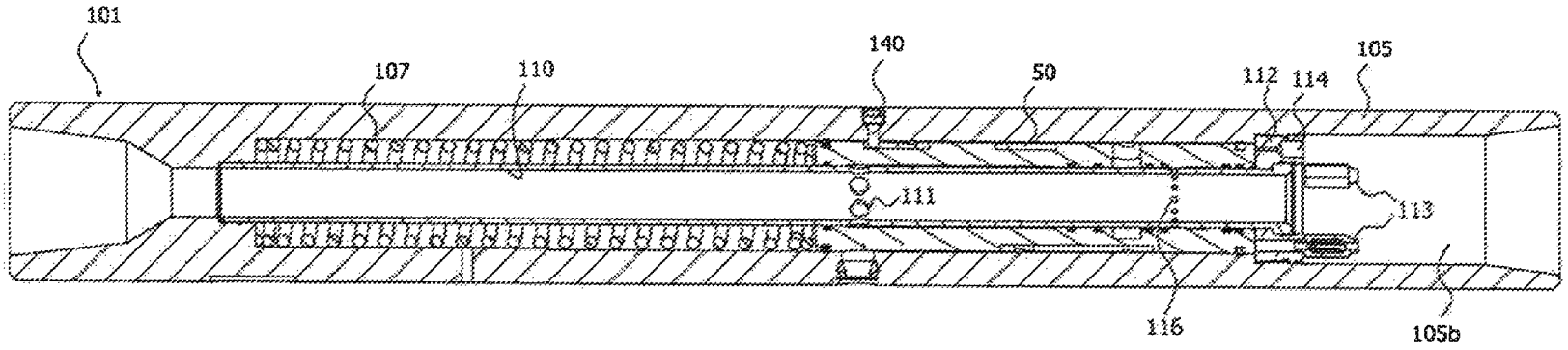
FIG. 10 is a side sectional view of a second circulation tool incorporating apparatus according to the invention, in a first closed configuration in which the pin is in a first loop, the bore pressure is low, and the circulation tool is closed.
Figure 11:
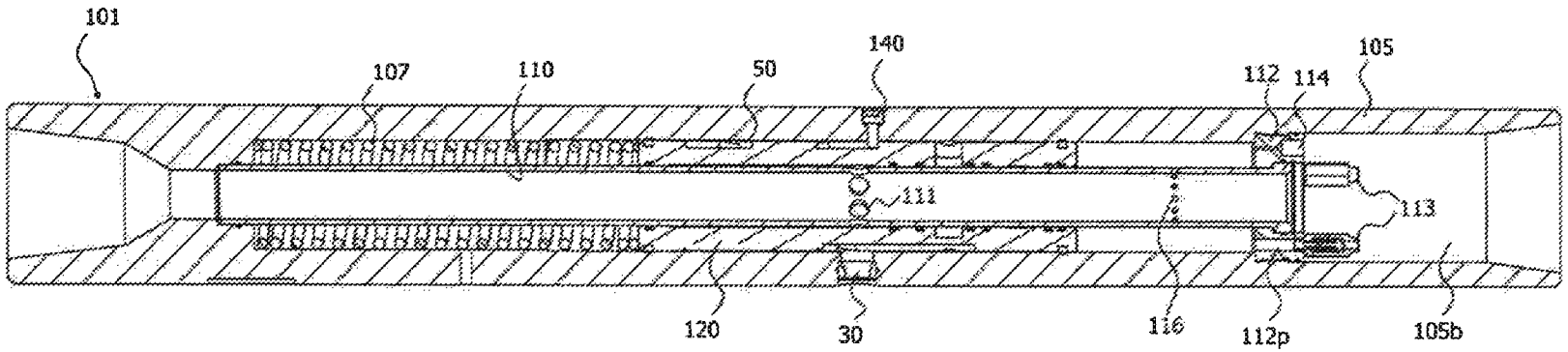
FIG. 11 is a side sectional view of the circulation tool of FIG. 10, in a second closed configuration, in which the pin is still in the first loop, the bore pressure is high, and circulation tool is again closed.
Figure 12:
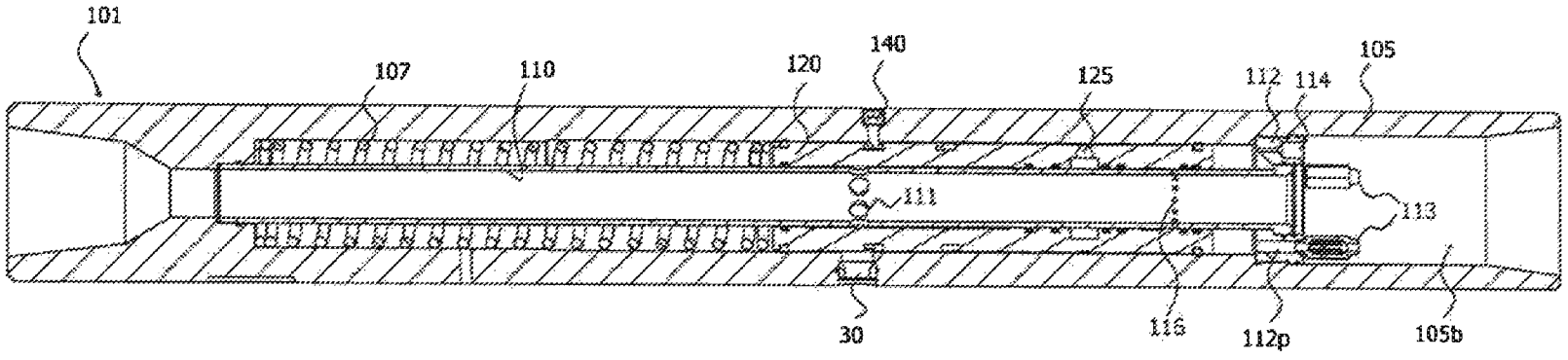
FIG. 12 is a side sectional view of the circulation tool of FIG. 10, in a third transitional configuration, in which the pressure is decreasing, and the pin is about to switch from the first loop into an adjacent elongated axial track.
Figure 13:
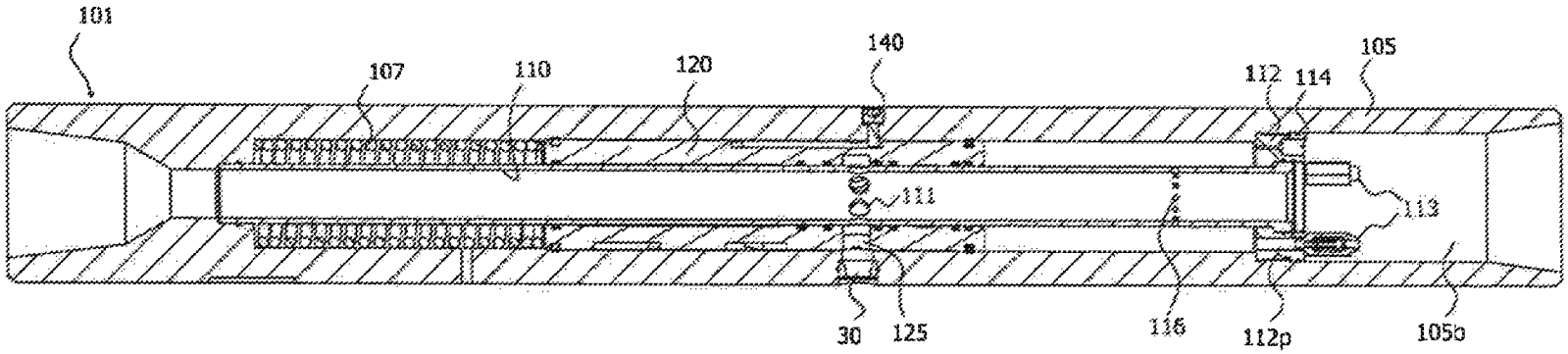
FIG. 13 is a side sectional view of the circulation tool of FIG. 10, in first open configuration, in which the pin is in the elongated axial track, the pressure is high, and the circulation tool is open, allowing fluid circulation.
Figure 14:
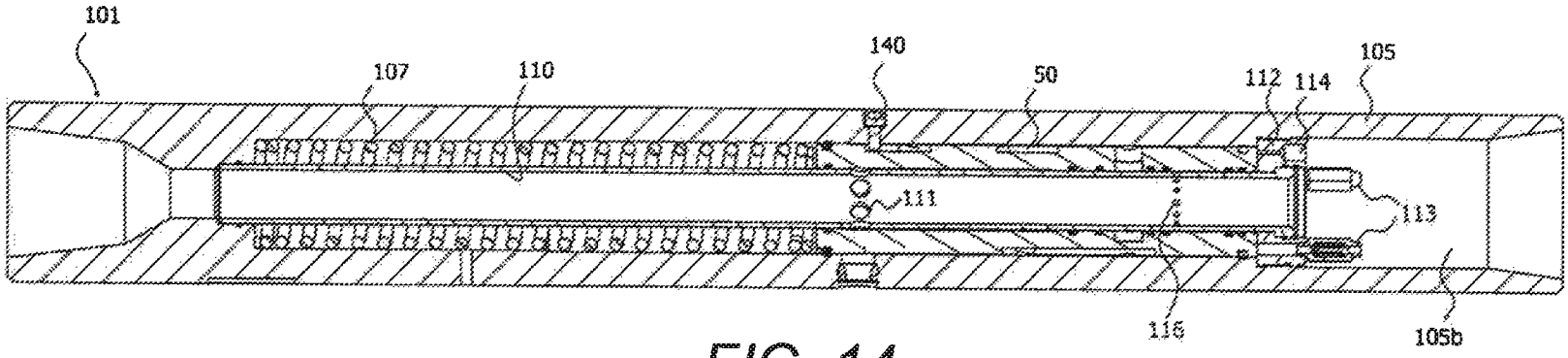
FIG. 14 is a side sectional view similar to FIG. 10, with the circulation tool in the closed configuration at low bore pressure, but in which the pin is in the elongated axial track.
Figure 15:
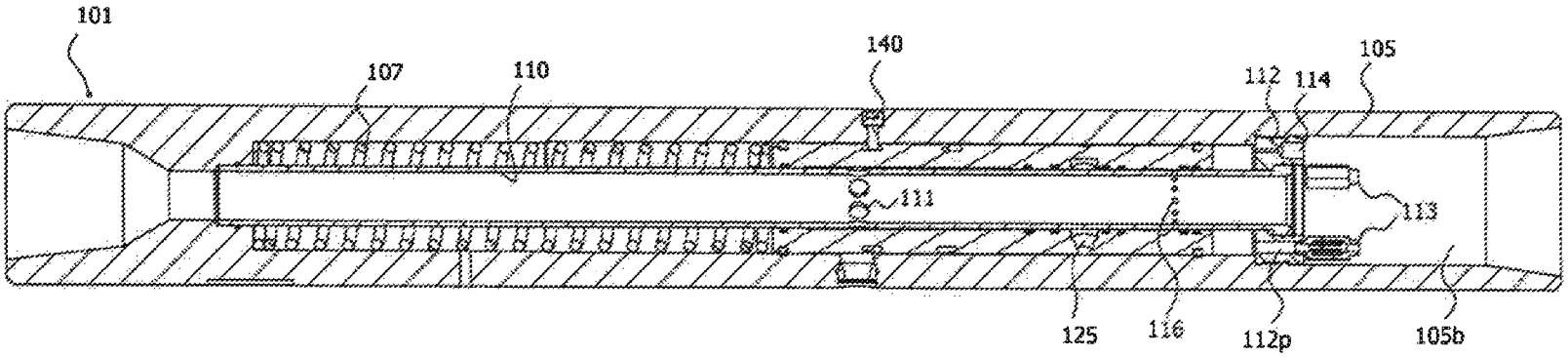
FIG. 15 is a side sectional view similar to FIG. 12, where the pressure is decreasing and the pin is about to transition into an adjacent elongated axial track.

The movement of the piston 20 within the bore 5*b* is regulated by a pin and slot arrangement, constraining the extent of axial movement of the piston 20 within the bore 5*b*, and guiding rotation of the piston around its axis. The piston 20 is in the form of sleeve having an axial bore, and in this example, the control slot is formed on the outer surface of the piston. The pin and slot arrangement is shown in FIG. 8. In this example, the pin 40 is inserted through a threaded bore passing laterally through the side wall of the body 5, and extends into the bore by a short distance, sufficient to engage the slot 50 and to retain the pin 40 within the slot 50 as the piston 20 moves up and down. The slot 50 is typically provided on the outer surface of the piston 20. In alternative examples, the slot can be provided on a separate sleeve that can be separately connected to the piston, or alternatively the piston can be provided with a pin, that extends laterally outwards into an inwardly facing slot provided on the inner surface of the bore, or on a separate sleeve connected with the bore. The pin and slot arrangement can be provided on the sub 1 of the apparatus, but this is not essential, and the pin and slot arrangement can be provided on a separate component.

The slot 50 in the sub 1 has at least one loop, each loop allowing the pin 40 to move between different configurations that define two different closed configurations of the piston 20, where the ports 25 through the piston are not aligned with the ports 30 through the body 5 and the ports 11 through the flow tube 10, and fluid communication does not take place. The slot 50 in the sub 1 also has at least one elongated axial track, arranged generally in an axial direction of body 5 and having a length in the axial direction longer than that of the track portion at a blind end of the loop in which the pin 40 moves between two different positions in the slot 50 corresponding to different configurations of the piston 20 in which fluid flow through the ports 30 is either allowed or disallowed.

The elongated axial track is connected to a first adjacent loop via a first deviate branch track 3*d*, and to a second adjacent loop via a second deviate branch track 4*d*. The elongated axial track does not form part of a loop. The first deviate branch track 3*d* and the second deviate branch track 4*d* do not form part of a loop, disallowing the pin to cycle back from the first deviate branch track 3*d* to second deviate branch track 4*d* or back to the elongated axial track. The slot 50 is configured not to return the pin 40 from the deviate branch track 4*d* back to the elongated axial track with P4 at its end, unless the pin 40 tracks around a generally circular path surrounding the piston 20 formed by the repetitive pattern of the elongated axial tracks and the loops.

The pin 40 can be switched from a loop to one of its adjacent elongated axial track at a time of the operator's choosing as will now be described, but also allows repeated cycling between the two configurations on each loop without necessarily switching between the two loops until the operator chooses to do so. The pin 40 can also enter a loop from one of its adjacent elongated axial tracks as will now be described. Therefore, the device can be cycled between different inactive configurations where, in both configurations, the outer ports 30 are closed and no fluid communication takes place through them; but at a time of the operator's choosing, the pin and slot arrangement can be switched to track the pin through the elongated axial track, and allow opening and closing of the outer ports 30.

Fluid pressure in the bore 5*b* is communicated to the piston 20 by means of an axial port 12*p* passing in an axial direction through the collar 12, thereby providing a fluid communication pathway between the bore 5*b* and the annulus between the flow tube 10 and the inner surface of the bore 5*b*. The inner and outer surfaces of the piston 20 are sealed above and below the ports 25. Therefore, pressure changes in the bore 513 are transmitted to the upper face of the piston 20 through the port 12*p*, thereby causing axial sliding movement of the piston 20 in response to pressure changes, e.g. to compress the spring 7 when the pressure is sufficiently high to overcome the spring force. Rotation of the piston around the flow tube 10 is governed by the constraint of the pin 40 within the slot 50, which cams the piston.

FIG. 1 shows the resting position of the control sub 1, in which the bore 513 is not pressurised, and the spring 7 is pushing the piston 20 up the annulus against the lower end of the collar 12. The counteracting force restraining the piston 20 against further axial movement is typically borne by the collar 12; although the pin 40 as shown in FIG. 1 is at the bottom end of the slot 50 on the outer surface of the piston 20, typically, the length of the slot 50 is engineered so that the force retaining the piston 20 is held by the thread securing the collar 12 in place on the inner bore of the body 5, and the pin 40 can be rated simply to guide the rotation of the piston 20 rather than also needing to retain the piston 20 against axial movement when the pressure is high. Typically, the spring force is relatively weak (approximately 300 ftlb at minimum compression and 1000 ftlb at maximum compression). As pressure is increased within the bore 5*b*, the fluid pressure is communicated through the port 12*p*, which pushes the piston 20 down within the annulus as shown in FIG. 2.

As is best seen with reference to FIG. 8, the pin 40 starts at point P1 on FIG. 8, at the lower end of a blind ended axial portion of the slot 50. As the piston 20 starts to move down relative to the stationary pin 40, the pin 40 tracks axially up the blind end of the axial portion and enters a deviated portion 1*d* which causes clockwise rotation of the piston 20 relative to the stationary pin 40 as the pin tracks anti-clockwise through the deviated portion. A further axial portion stops the rotation but guides the axial movement of the piston 20 until the slot 50 enters a further deviated portion 1*d*' this time tracking in a clockwise direction towards a further blind ended axial portion of the slot, which terminates at position P2, corresponding to the position of the slot 40 shown in FIG. 2. The tracking of the pin 40 from the first blind ended axial bore, through the first anti-clockwise deviation 1*d*, through the first axial transition to the second deviated clockwise track 1*d*' and finally leading to the second blind ended axial bore at P2 is the first track of the loop of the slot 50.

Figure 2:
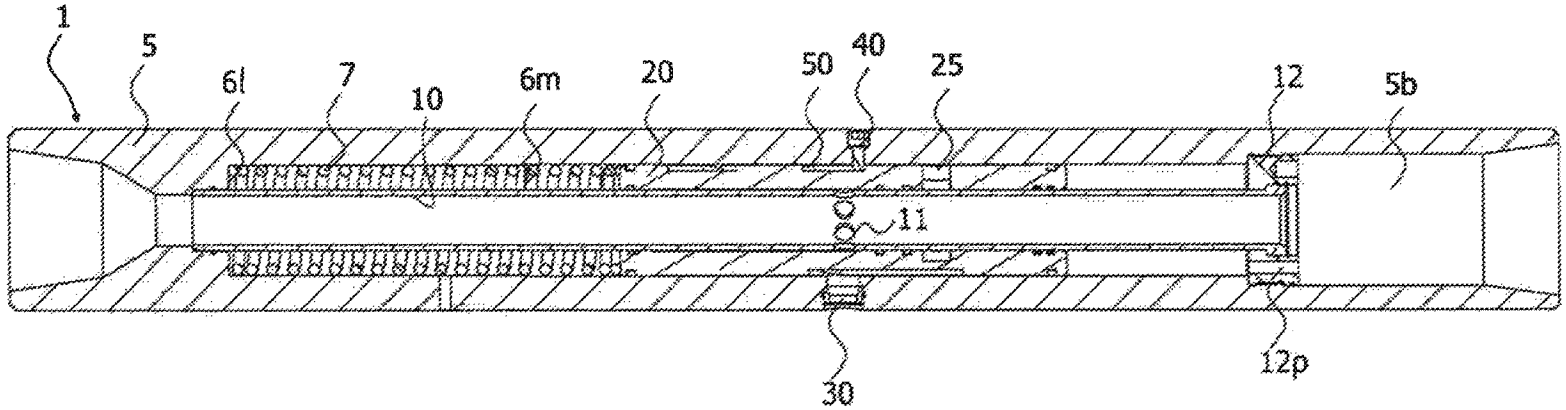
FIG. 2 is a side sectional view of the circulation tool of FIG. 1, in a second closed configuration, in which the pin is still in the first loop and the circulation tool is again closed.

In the position shown in FIG. 2, the pin 40 has tracked to the upper end of the first track in the loop, terminating at position P2 shown in FIG. 8. At this position the piston is restrained against further axial upward movement. Therefore, the ports 25 do not come into register with the ports 11, 30, and fluid circulation cannot take place. As fluid pressure is backed off in the bore 5*b*, for example by decreasing activity of the pumps on the surface, the force of the spring 7 eventually is able to overcome the fluid pressure and force the piston 20 back up the annulus, so that the pin 40 begins to move down the slot 50. Starting from position P2, with the pin 40 in the slot 50 as shown in FIG. 2, the pin 40 tracks down the blind ended axial slot, but does not enter the deviated section of the first track 1*d*', and instead enters a deviated section 2*d* of the second track or return track of the loop. The second (or return) track of the loop comprises a first deviated section 2*d* extending anti-clockwise, an axial section and a second deviated section 2*d*' returning in a clockwise direction and converging with the blind ended axial portion corresponding to the first track at P1, where the pin 40 started its journey in FIG. 1. Provided that the piston 20 continues to move upwards so that the pin tracks continuously down the second return track, the pin 40 will cycle back to the starting position at P1, ready for another cycle through the first track. The sub 1 can cycle repeatedly in this manner within the two tracks of the loop, pressuring up and down for any number of desired cycles without activating the tool. This is useful, because it is typically necessary to stop the pumps at the surface from time to time, for example to make up a string connection, to add another stand of pipe, or to remove one. Therefore, with the apparatus according to the present example, the pumps can be activated and deactivated at the surface to add or remove any number of lengths of pipe to the string without affecting the activation or de-activation of the tool controlled by the sub 1, because the pin is simply cycling within the two tracks of the loop, in which both ends of the slot correspond to inactive configurations of the tool.

The first and second tracks described above make up the loop, and allow the pin 40 to cycle through the loop as many times as is needed for making up various connections or breaking them at the surface, without activating or de-activating the downhole tool controlled by the sub 1.

Figure 4:
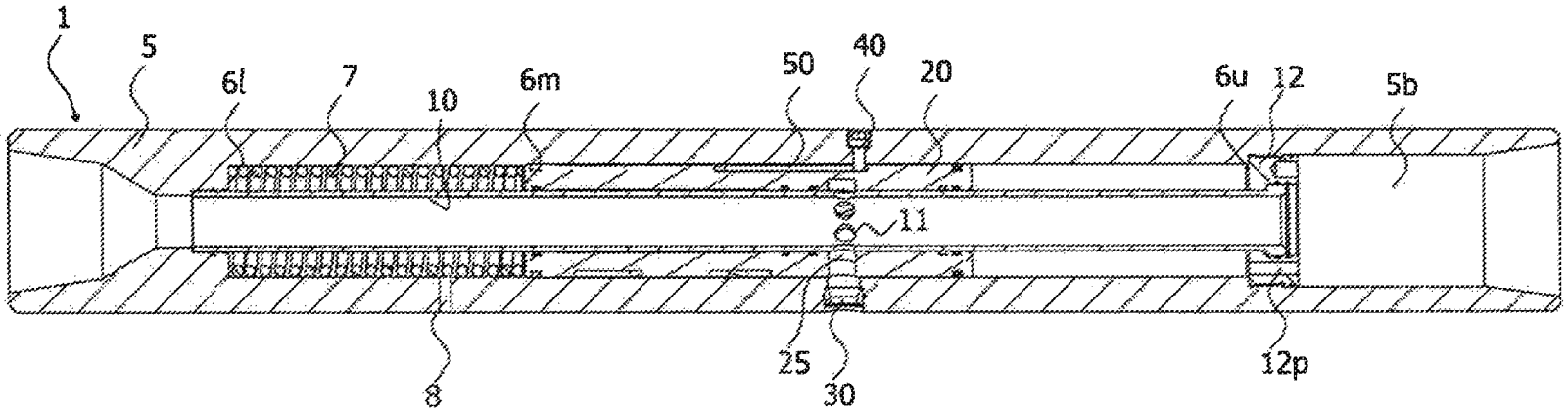
FIG. 4 is a side sectional view of the circulation tool of FIG. 1, in first open configuration, in which the pin is in the elongated axial track and the circulation tool is open.

When the sub 1 is ready to open the circulation ports 30, the pin 40 is cycled though the first track from position P1 to P2 as shown in the transition between FIGS. 1 and 2, and on the return or second track of the loop, the pin is switched from the loop to the elongated axial track. This is done on the second track of the loop, and particularly, in this example, when the pin 40 has emerged from the first deviated part of the second track, and before it has left the second deviated track, to re-enter the first axial track corresponding to the starting position P1. At some point in this transition area P3 between the end of the first deviated portion and the end of the second deviated portion, the direction of movement of the sleeve/piston is reversed by typically switching or adjusting the pumps at the surface, e.g. increasing their level of activity to cause the piston 20 to change axial direction within the annulus. At that point P3, instead of moving down the second track in the transitional area between the end of the first deviated part and the end of the second deviated part, the piston 20 starts to move down in the annulus, and the pin 40 correspondingly moves up the transitional portion of the slot 50. At the top of the axial portion of the second track, the second track branches into a Y-junction, one limb of which branches off to form the first deviated portion of the second track in the first loop, and the other limb (which is typically axially aligned with the axial portion) leads to the elongated axial track. Because of the geometry of the slot, when the pin 40 is moving up the transitional portion, it is tracked into the elongated axial track, and does not return into the deviated part 2*d* of the second track of the loop. Accordingly, the pin 40 tracks through a deviated section of the elongated axial track to position P4, to the end of the elongated axial track corresponding to the position of the sub 1 shown in FIG. 4. The elongated axial track at P4 permits longer axial travel of the piston 20 down the annulus until it bottoms out on the middle step 6*m*, which forms a piston stop shoulder and at that point the piston 20 can no longer move axially downwards. At the same point, the pin 40 is located at position P4, and is at or near the very top of the slot as shown in FIG. 4, but the reaction force counteracting the fluid pressure is typically borne by the step 6*m* rather than being completely held by the pin 40 (although it could be). In that position P4, the ports 11, 25 and 30 are axially aligned thereby allowing fluid communication between the inner bore of the flow tube, through the flow tube ports 11, piston ports 25, and through the body ports 30, to the outside of the tool as shown in FIG. 4. Optionally the ports 11 can also be circumferentially aligned with the ports 25 and 30, but this is not essential. This permits fluid to be circulated from the bore 513 above the control sub 1 through the ports in order to circulate fluid at high pressures, which is useful for keeping debris in circulation, thereby enabling them to be recovered back to the surface. Circulation continues on this way at high pressure allowing the circulation sub embodying the invention to maintain, for example, drill cuttings and other debris in the annulus between the outside of the body 5 and the inner surface of the wellbore in suspension and helping to wash it back to the surface.

Figure 5:
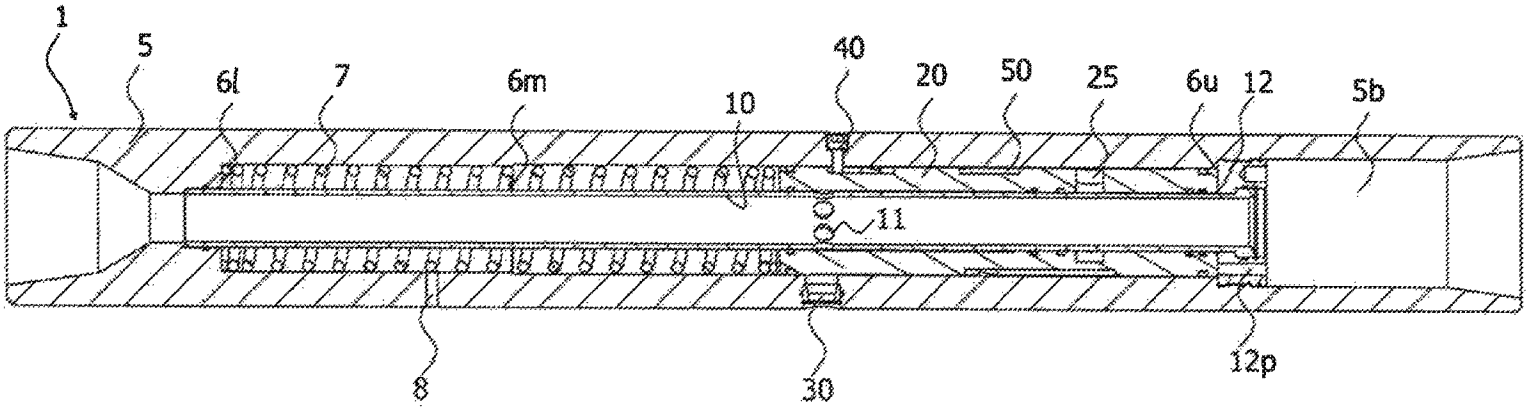
FIG. 5 is a side sectional view similar to FIG. 1, with the circulation tool in the closed configuration, but in which the pin is in a second loop.
Figure 6:
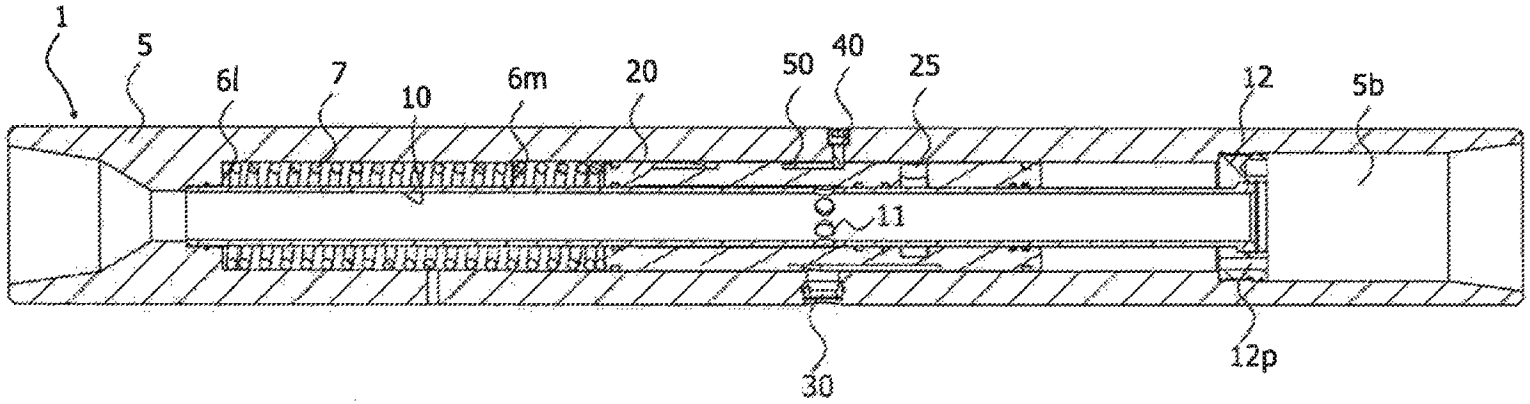
FIG. 6 is a side sectional view similar to FIG. 2, with the circulation tool in an open configuration, but in which the pin is in the elongated axial track.
Figure 7:
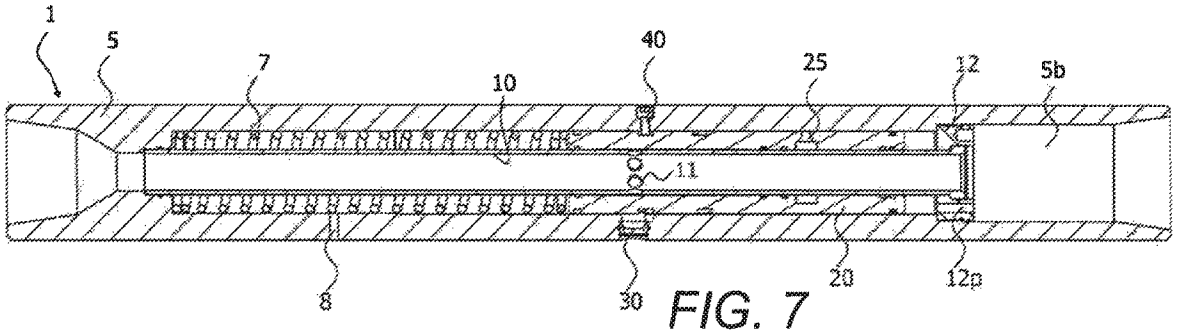
FIG. 7 is a side sectional view similar to FIG. 3, where the pin is about to switch into a next elongated axial track.
Figure 9:
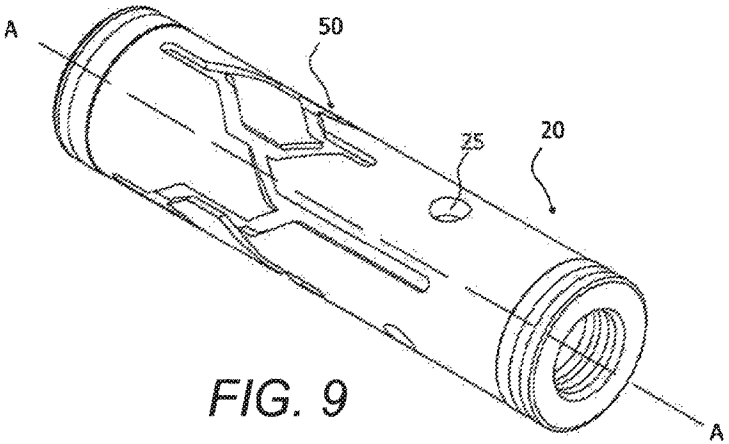
FIG. 9 is a perspective view of the piston of the FIG. 1 apparatus showing the split line A-A.

When circulation operations have been completed, and the circulation is to be ceased, the pumps are switched off (or otherwise adjusted) at the surface, and the force of the spring returns the piston 20 to the FIG. 5 position, by movement of the pin back along the elongated axial track. As with the other side of the loop, there is a transition zone P5 between a second deviated branch of the elongated axial track and the first track of the next loop, so when the pin 40 reaches the end of the second deviated branch of the elongated axial track, it enters the next loop. Before the pin 40 reaches the end of the second deviated section, the direction of movement of the piston 20 can be reversed by adjusting the pumps from surface, causing the pin 40 to track in the opposite direction at transition zone P5 shown in FIG. 8, moving back in the opposite direction to enter the first track of the next loop, terminating eventually at the end of the short blind ended bore at P2' shown in FIG. 8. The control sub is then effectively back at the P2 position shown in FIG. 2, but has cycled from the first loop, through the elongated axial track and has now entered a subsequent loop, and the pin can track back to the P1' position in that next loop moving the piston back to the position shown in FIG. 1 (but moved around through one cycle) ready to commence further operations starting from the beginning. Therefore, the pin 40 will not be tracked into the elongated axial track from a first loop without a reversal of its movement direction under an operator's manipulation. However, when the pin 40 leaves the elongated axial track through a deviate branch, due to the geometry of the slot 50, the pin is forced to enter a second, different loop via the deviated branch of the elongated axial track and cannot return to the elongated axial track unless the pin travels in slot 40 circumferentially around the body 5 by one revolution and returns back to the point for entry into the elongated axial track. If an operator keeps alternating the relative movement direction between the pin 40 and slot 50, the pin will move from a blind end of a loop to the junction between the loop and a next elongated axial track, then to the end point of the elongated track, then to the junction between the elongated axial track and a next loop and so on (i.e. from P2 to P3 to P4 to P5 and so on in FIG. 8). This arrangement helps simplifying the operation procedure of the downhole device.

FIGS. 10-15 show a further example 101 of the control sub of FIGS. 1-9, with similar parts, which will be referred to with the same reference numbers, but increased by 100, and parts that are shared with the earlier example will not be described in detail here, but the reader is referred to the previous disclosure for an illustration of the structure and function of the corresponding parts of this example. In the second example of FIGS. 10-15, the piston 120, pin 140, slot 50, body 105, spring 107, collar 112, ports 111, 125 and 130 are all typically the same as previously described. The second example differs in the flow tube 110 and the collar 112, which have an optional feature that controls the speed of movement of the pin through the transitional portion, typically allowing more time to switch tracks.

The flow tube has a set of circumferentially arranged small ports 116 arranged in a ring passing through the wall of the flow tube 110 near to the upper end of the flow tube 110. The precise axial distance of the ring of small ports 116 is typically selected in accordance with passage of the pin 140 past the junction between a loop and an elongated axial track of the slot 50, at the start of the axial section of the second track of the slot 50, as will be explained further below, but this distance can be varied if desired without departing from the scope of the invention. The piston seals above and below the ring of small ports 116 in the FIG. 10 position, and the upper annular seal on the inner face of the piston is close to the upper end of the piston.

The modified collar 112 still has a port 112*p* to admit fluid under pressure from the bore 105*b*, but this is provided with a one way check valve 113, allowing fluid to pass into the annulus from the bore 105*b*, but preventing fluid egress from the annulus back through the valve 113 into the bore 105*b*. Typically three ports 112*p* are provided each having a respective one-way valve 113. The valves typically allow high pressures and high flow rates of fluid in the direction permitted, allowing rapid flooding of the annulus and rapid transmission of pressure to the piston 120, leading to relatively few transmission losses. The collar also has, typically spaced equidistantly between adjacent ports 112*p*, at least one, and optionally more than one bleed valve 114 allowing fluid flow from the annulus back into the bore 105*b*. The bleed valve 114 can optionally be adjustable. The bleed valve typically has a very small bore, or can be adjustable to allow only very small flow rates through the bleed valve 114, typically much less than the port 112*p* and check valve 113. As the piston 120 is sealed in the annulus on its inside and outside surfaces, fluid can only escape from the annulus above the piston through the bleed valve 114. Therefore, the speed at which fluid can escape through the bleed valve determines the speed at which the piston can move back up the annulus after pressure has been reduced. This speed of movement can therefore be adjusted by the setting of the bleed valve.

In operation, the application of pressure to the bore 105*b* drives the piston 120 down the annulus, moving the pin 140 up the slot from position P1 to P2. The device can cycle between settings P1 and P2 as previously described. The annulus floods quickly due to the large bore ports 112*p* and the one way valves 113 do not substantially restrict flooding of the annulus so the piston moves down (and the pin moves up through the first track of the loop) relatively quickly to the position shown in FIG. 2.

However, the movement of the piston back up the annulus (and the downward movement of the pin back down the second (return) track of the loop requires the fluid in the annulus above the piston to escape from the annulus before the piston 120 moves up. The fluid in the annulus cannot pass through the check valves 113. When the piston is in the position shown in FIG. 2, and the pin 140 is in the position P2, the fluid in the annulus can escape back to the bore 105*b* via the small ports 116, as well as through the bleed valve 114. The combined flow area of the small ports 116 is relatively large and the initial upward movement of the piston 120 is rapid as the fluid exhausts mainly through the small ports 116. When the uppermost piston seals pass the small ports 116, the pin has just moved past the Y-junction between the loop and the elongated axial track is in the transition zone at P3, ready to switch from the loop into the elongated axial track. At this point the seals on the piston cover the small ports 116 denying fluid passage through the small ports 116, so that the fluid in the annulus can only escape through the small bore bleed valve 114 in the collar 112. The flow rate through the small bore bleed valve is much slower than the flow through the small bores 116 and the ports 112*p*, and the ports 112*p* are closed by the check valves 113, so the piston 120 moves very slowly through the transition zone P3, and the pin therefore remains in the transition zone P3 for a longer period, which can be adjusted by manipulating the pressure differential, and the setting of the bleed valve. The typical settings can allow the pin to remain in the transition zone of the second (return) track at position P3 for e.g. 15 seconds-2 minutes or longer, depending on the characteristics of the bleed valve 114 and the pressure differential. The pumps at surface can be stopped if desired, and changes to the string can be made as previously described, by cycling the pin repeatedly in the inactive loop.

Switching from a loop to an elongated axial track typically only takes place when the operator decides. For switching from a loop to an elongated axial track, the operator typically increases flow rates, causing the pin to travel to position P2, and the operator then reduces (or cuts off completely) the pressure from surface pumps for approximately 15 seconds-2 minutes to allow the pin to travel to the transition zone P3, and then while the pin is still in the transition zone P3, the operator again increases the flow rate to move the pin to position P4. The annulus floods by wellbore fluid passing through the large bore check valves 113 and ports 112*p* to drive the piston 120 down the annulus (and the pin 140 up the slot 50) to position P4, which can be done quickly as a result of the higher flow areas of the ports 112*p* and check valves 113. Therefore, the second example allows the operator to manipulate the timing of the transition phase with more control. The other operations of this example are similar to the operations previously described for the last example. Any drill string activity while the pumps are switched off typically takes longer than the 15 s-2 minutes transition time for the pin to return through the transition zone P3 to position P1. This allows drill string changes to add or remove stands of pipe to be performed while the pin continues cycling within the two tracks of the loop. Usually adding a stand of drill pipe to the drill string will take more than 2 minutes.

Figure 16:
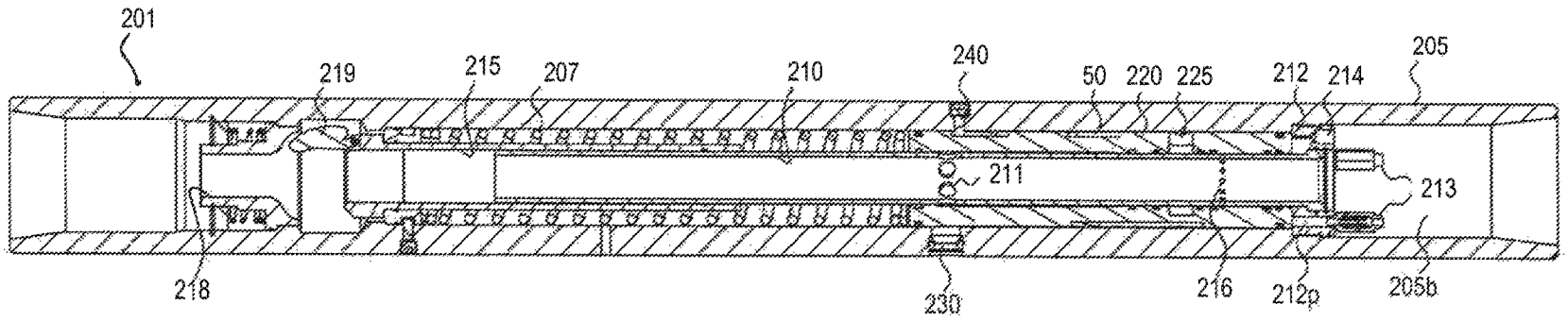
FIG. 16 is a side sectional view of a third circulation tool incorporating apparatus according to the invention, in a first closed configuration in which the pin is in a first loop, the bore pressure is low, and the circulation tool is closed, with the internal passage through the tool being open.
Figure 17:
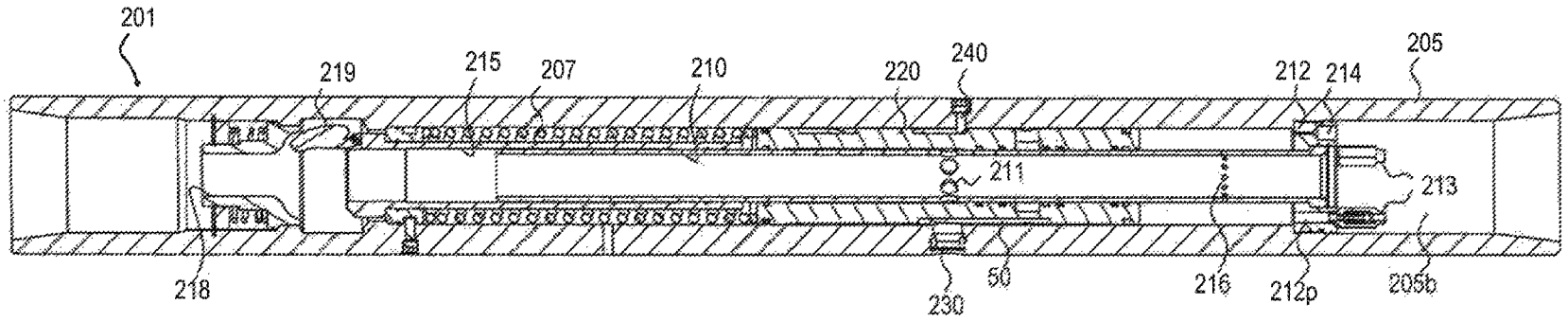
FIG. 17 is a side sectional view of the circulation tool of FIG. 16, in a second closed configuration, in which the pin is still in the first loop, the bore pressure is high, and circulation tool is again closed, with the internal passage through the tool being open.
Figure 18:
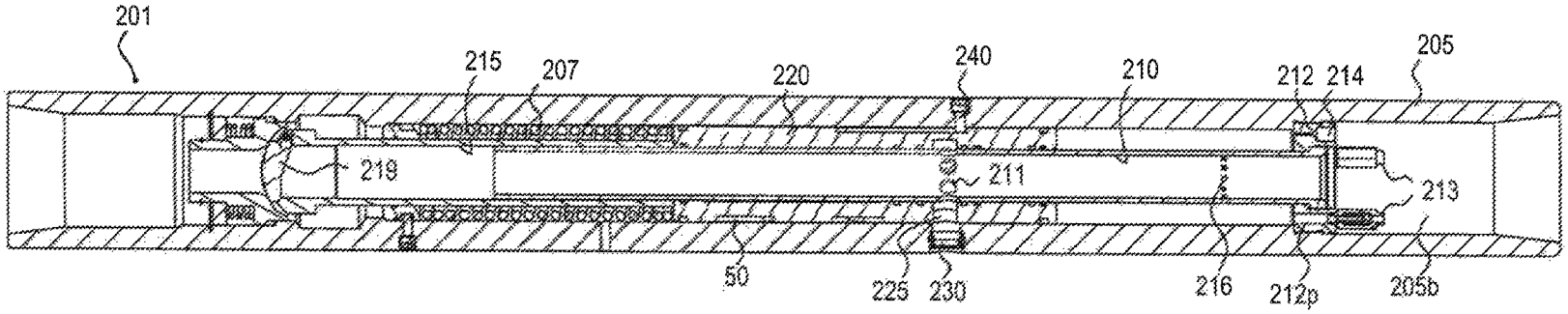
FIG. 18 is a side sectional view of the circulation tool of FIG. 16, in first open configuration, in which the pin has moved into the elongated axial track, the pressure is high, and the circulation tool is open, allowing fluid circulation, and wherein the internal passage through the tool is closed.
Figure 19:
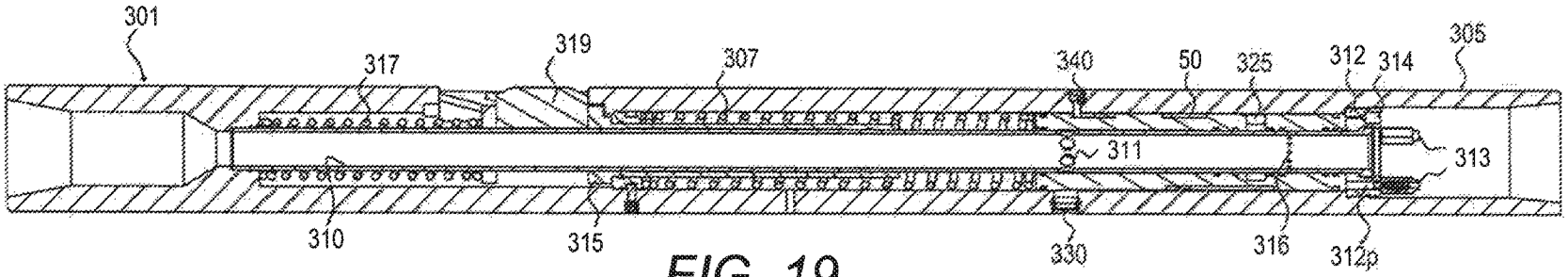
FIG. 19 is a side sectional view of a reaming tool, in a first closed configuration in which the pin is in a first loop, the bore pressure is low, the cutter is retracted and the circulation port is closed.
Figure 20:
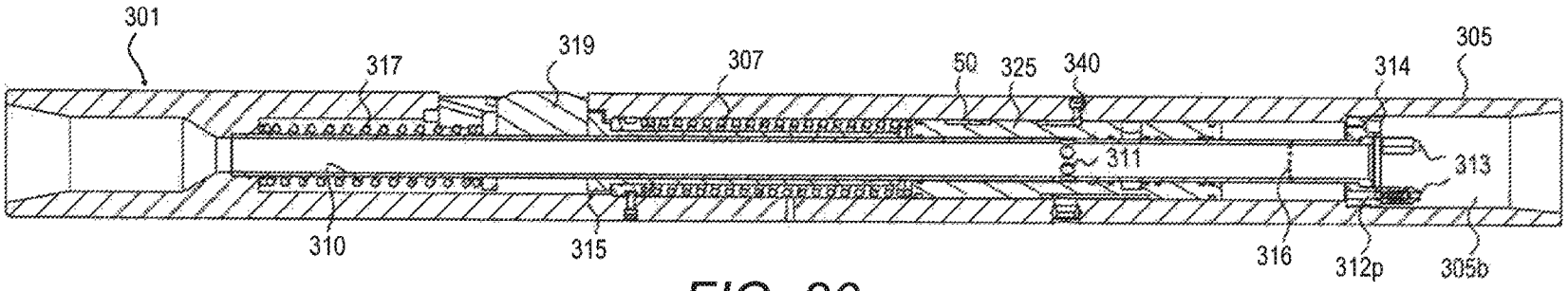
FIG. 20 is a side sectional view of the tool of FIG. 19, in a second closed configuration, in which the pin is still in the first loop, the bore pressure is high, the cutter is retracted and the circulation port is closed.
Figure 21:
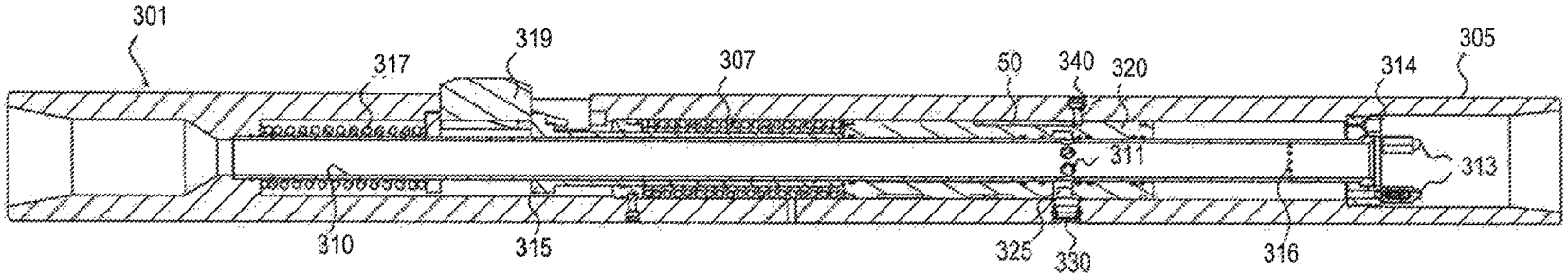
FIG. 21 is a side sectional view of the tool of FIG. 19, in first open configuration, in which the pin is in the elongated axial track, the pressure is high, the cutter is extended, and the circulation port is open.
Figure 22:
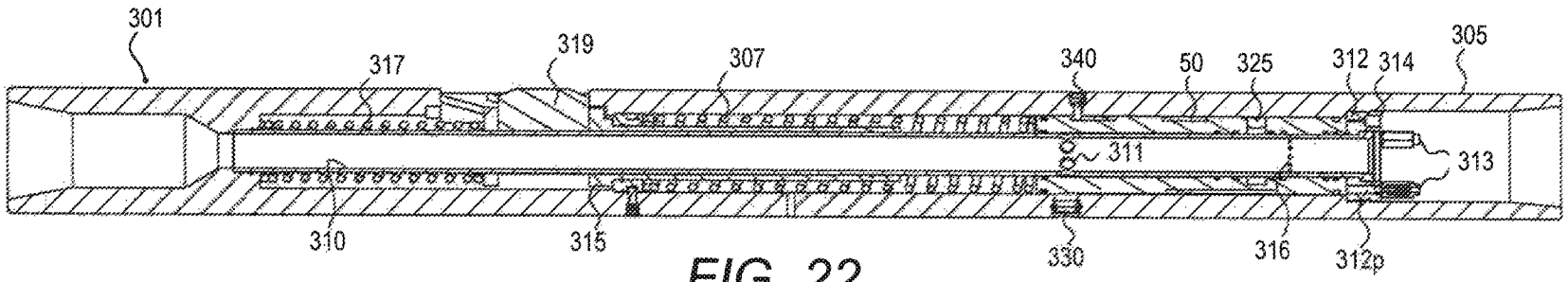
FIG. 22 is a side sectional view of the tool of FIG. 19, with the cutter in the closed configuration at low bore pressure, but in which the pin is in a next loop, the cutter is retracted and the circulation port is closed.
Figure 23:
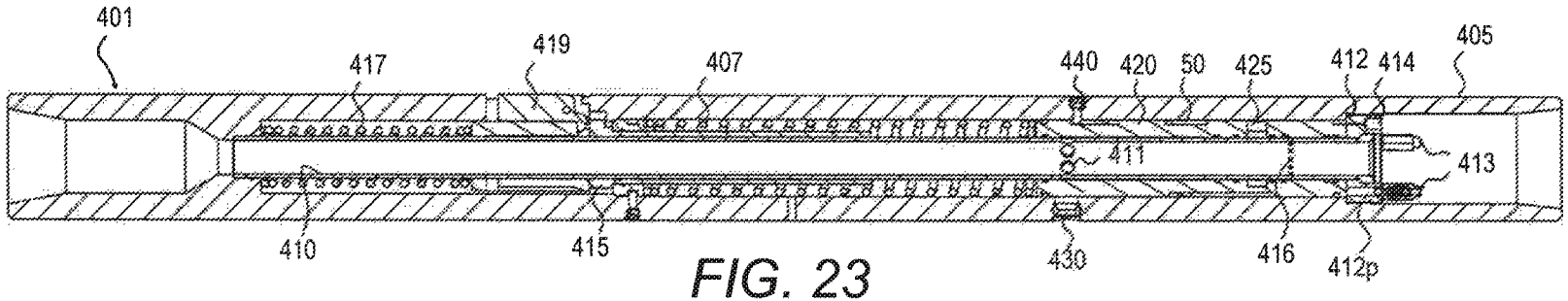
FIG. 23 is a side sectional view of a modified reaming tool, in a first closed configuration in which the pin is in a first loop, the bore pressure is low, the cutter is retracted and the circulation port is closed.
Figure 24:
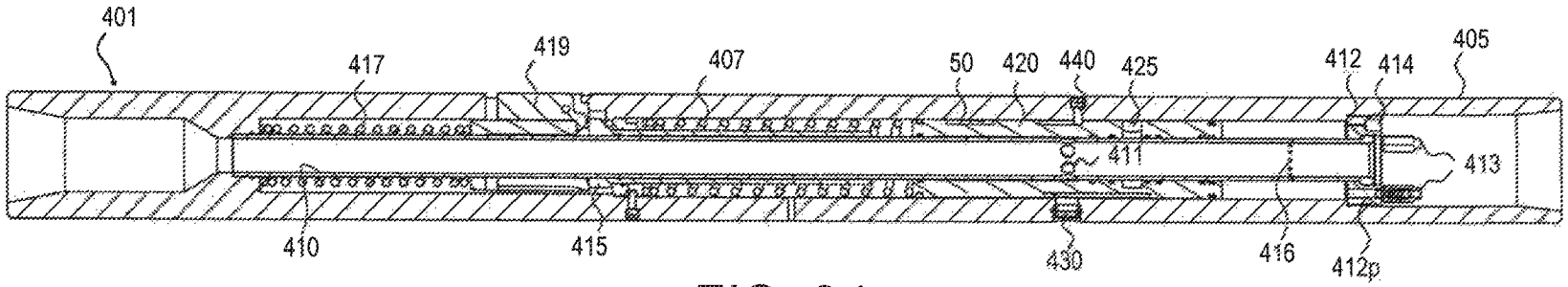
FIG. 24 is a side sectional view of the tool of FIG. 23, in a second closed configuration, in which the pin is still in the first loop, the bore pressure is high, the cutter is retracted and the circulation port is closed.
Figure 25:
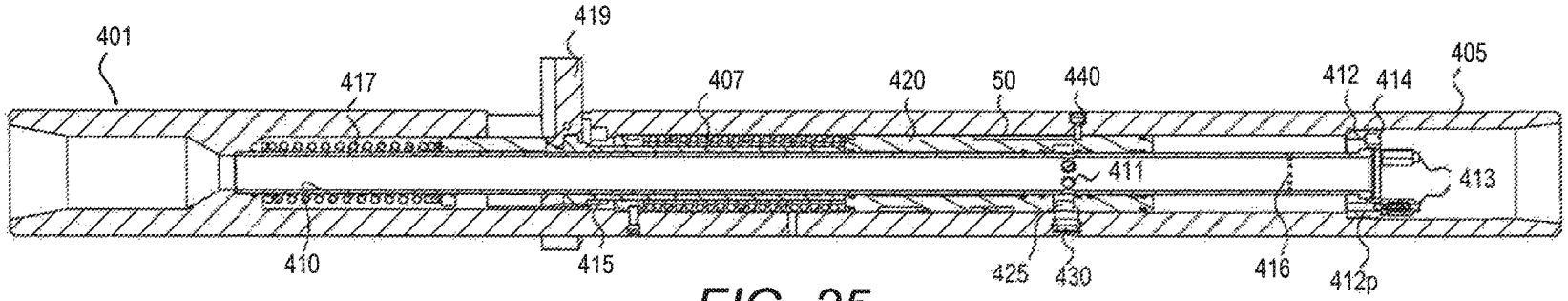
FIG. 25 is a side sectional view of the tool of FIG. 23, in first open configuration, in which the pin is in the elongated axial track, the pressure is high, the cutter is extended and the circulation port is open.
Figure 26:
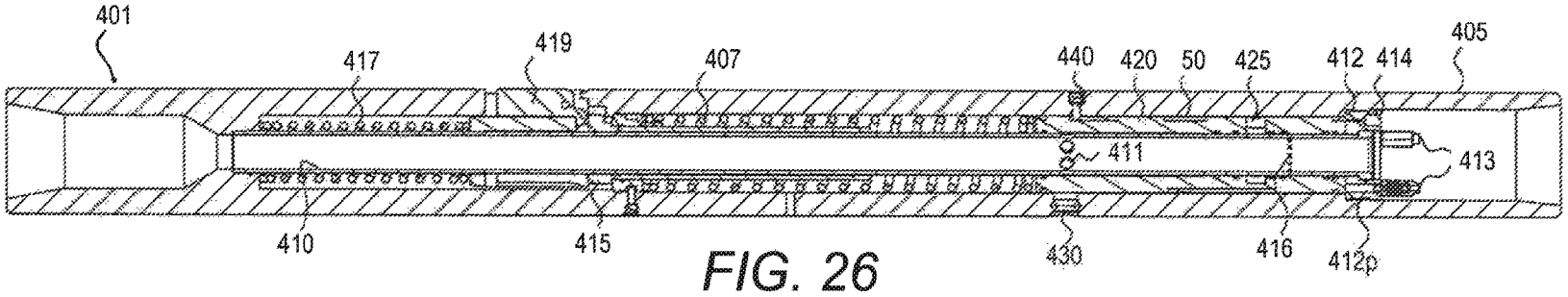
FIG. 26 is a side sectional view of the tool of FIG. 23, with the cutter in the closed configuration at low bore pressure, but in which the pin is in a next loop, with the cutter retracted and the circulation port closed.

FIGS. 16-18 show a modified example 201 of the control sub 101 of FIGS. 10-15, with similar parts, which will be referred to with the same reference numbers, but increased by 100, and parts that are shared with the earlier examples will not be described in detail here, but the reader is referred to the earlier examples for an illustration of the structure and function of the corresponding parts of this example. In the third example of FIGS. 16-18, the piston 220, pin 240, slot 50, body 205, spring 207, collar 212, ports 211, 225 and 230 are all typically the same as previously described.

The flow tube 210 has the same arrangement of small ports 216 with piston seals above and below the ring of small ports 216.

The modified collar 212 has a port 212*p* to admit fluid under pressure from the bore 205*b*, with a one way check valve 213 similar to the valve 113, allowing fluid to pass into the annulus from the bore 205*b*, but preventing fluid egress from the annulus back through the valve 213 into the bore 205*b*. Typically three ports 212*p* are provided each having a respective one-way valve 213. The collar 212 also has, typically spaced equidistantly between adjacent ports 212*p*, at least one, and optionally more than one bleed valve 214 allowing fluid flow from the annulus back into the bore 205*b*. The bleed valve 214 is typically adjustable as previously described for the second example and allows control over the speed at which fluid can escape through the bleed valve and thus the speed at which the piston can move back up the annulus after pressure has been reduced, which can be adjusted by the setting of the bleed valve, as previously described for the last example.

The third example illustrates how certain devices embodying the invention can typically be used to close the bore below the circulation port, and divert more of the fluid through the circulation port. The present example differs from the second example in that the lower end of the spring 207 is stopped by a collet that shoulders on an upwardly facing shoulder surrounding a narrowed throat of the bore 205*b*. The lower end of the flow tube carries a valve tube 215, held against rotation in the bore 205*b* by a guide pin. The valve tube 215 passes through the throat at the shoulder, and on its lower end, the valve tube 215 carries a closure device such as a flap 219 which is typically hinged to one side of the valve tube 215. The upper face of the flap 219 is adapted to seal off the lower end of the valve tube 215, thereby closing the bore through the sub 201. The lower face of the flap 219 is formed to interact with the arcuate upper face of a funnel 218 that gradually curves to guide the closure of the flap around the axis of the hinge as the flap and valve tube move axially down the bore 205*b* of the sub 201. When the valve tube has moved down the bore of the sub 205*b*, the arcuate upper surface of the funnel 218 has guided the closure of the flap 219 over the lower end of the valve tube 215. Accordingly all fluids passing through the upper end of the flow tube 210 are diverted through the ports 225, 230 when they are aligned, and it is thereby possible to create more turbulent circulation conditions in the annulus outside the body 205*b*.

The operation of this example is otherwise similar to the previous version; the application of pressure to the bore 205 drives the piston 220 down the annulus, moving the pin 240 up the slot from position P1 to P2. The device can cycle repeatedly between settings P1 and P2 as previously described, without switching from a loop to an elongated axial track until the operator is ready. The annulus floods quickly due to the large bore ports 212*p* and the one way valves 213 do not substantially restrict flooding of the annulus so the piston moves down (and the pin moves up through the first track of the loop) relatively quickly to the position shown in FIG. 2.

Figure 3:
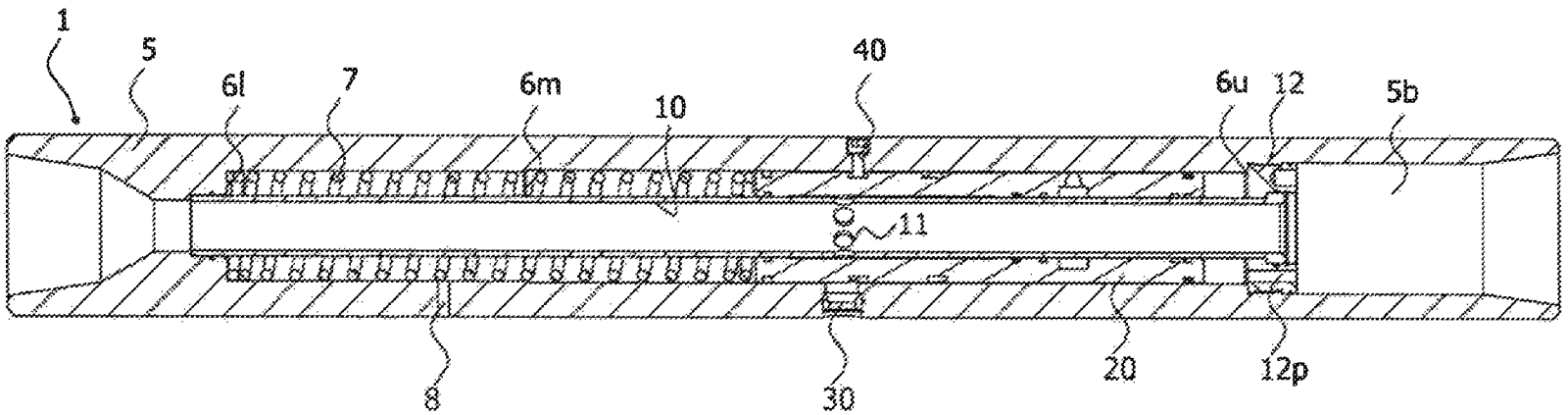
FIG. 3 is a side sectional view of the circulation tool of FIG. 1, in a third transitional configuration, in which the pin is about to transition into the adjacent elongated axial track.

The movement of the piston back up the annulus (and the downward movement of the pin back down the second (return) track of the loop as shown in FIG. 3 requires the fluid in the annulus above the piston to escape from the annulus before the piston 220 moves up. The fluid in the annulus cannot pass back through the check valves 213. When the piston is in the position shown in FIG. 2, and the pin 240 is in the position P2, the fluid in the annulus can pass into the bore 205*b* via the small ports 216. The combined flow area of the small ports is relatively large and the initial upward movement of the piston 220 is rapid as the fluid exhausts through the small ports 216. When the uppermost piston seals pass the small ports 216, the pin has just moved past the Y-junction between the loop and the elongated axial track and is in the transition zone at P3, ready to transition (if desired) from the loop into the elongated axial track. At this point the seals on the piston cover the small ports 216 denying fluid passage through the small ports 216, so that the fluid in the annulus can only escape through the small bore bleed valve 214 in the collar 212. The flow rate through the small bore bleed valve is much slower than the flow through the small ports 216 and the ports 212*p*, so the piston 220 moves very slowly, and the pin remains in the transition zone P3 for a longer period, which can be adjusted by manipulating the pressure differential, and the setting of the bleed valve. The typical settings can allow the pin to remain in the transition zone of the second (return) track at position P3 for 15 seconds-2 minutes (for example) or longer. The pumps at surface can be stopped if desired, and changes to the string can be made as previously described. When the operator decides, the annulus can be flooded once again through the check valves 213 and ports 212*p* to drive the piston 220 down the annulus (and the pin 240 up the slot 50) to position P4, which can be done quickly as a result of the higher flow areas of the ports 212*p* and check valves 213.

The flap 219 only engages the funnel 218 when the pin moves into the elongated axial track and into position P4. Therefore, the third example also allows the operator to manipulate the timing of the transition phase with more control, and can apply more of the wellbore pressure to the circulation ports 230 as a result of the closure of the bore 205*b* by the flap 219.

FIGS. 19-22 show a reaming device incorporating a fourth example 301 of a control sub, with similar parts as previously described, which will be referred to with the same reference numbers, but increased by 100, and parts that are shared with earlier examples will not be described in detail here, but the reader is referred to the earlier examples for an illustration of the structure and function of the corresponding parts of this example. In the fourth example of FIGS. 19-22, the piston 320, pin 340, slot 50, body 305, spring 307, collar 312, ports 311, 325 and 330 are all typically the same as previously described. The flow tube 310 has the same arrangement of small ports 316 with piston seals above and below the ring of small ports 316. The modified collar 312 has ports 312*p*, check valves 313, and bleed valves 314 as previously described for previous examples.

The fourth example differs from previous versions in that it in addition to a circulation sub, it comprises a cutting tool which in this example is in the form of an under-reamer. The lower end of the spring 307 is landed on an upwardly facing shoulder of an actuator sleeve 315 pushing a cutter 319 radially outward from the body. When the actuator sleeve 315 moves down the bore of the sub 305*b*, the cutter 319 is moved up a ramp against the force of a retaining spring 317 to extend radially out of the body 305 and initiate cutting operations.

In operation, the application of pressure to the bore 305*b* drives the piston 320 down the annulus, moving the pin 340 up the slot from position P1 to P2. The device can cycle between settings P1 and P2 as previously described. The annulus floods quickly due to the large bore ports 312*p* and the one way valves 313 do not substantially restrict flooding of the annulus so the piston moves down (and the pin moves up through the first track of the loop to position P2) relatively quickly to the piston position shown in FIG. 20.

The repeated cycling movement of the piston back up the annulus (and the downward movement of the pin back down the second (return) track of the loop is controlled via the small ports 316 and bleed valve 314 as previously described. When the uppermost piston seals pass the small ports 316, the pin has just moved past the Y-junction between the loop and the elongated axial track and is in the transition zone at P3, ready to transition from the loop into the elongated axial track. At this point the seals on the piston cover the small ports 316 denying fluid passage through the small ports 316, so that the fluid in the annulus can only escape through the small bore bleed valve 314 in the collar 312. The flow rate through the small bore bleed valve is much slower than the flow through the small bores 316 and the ports 312*p*, so the piston 320 moves slowly, and the pin remains in the transition zone P3 for a longer period, which can be adjusted by manipulating the pressure differential, and the setting of the bleed valve. The typical settings can allow the pin to remain in the transition zone of the second (return) track at position P3 for 15 seconds-2 minutes or longer. The pumps at surface can be stopped if desired, and changes to the string can be made as previously described, at a time of the operator's choosing. The annulus can be flooded through the check valves 313 and ports 312*p* to drive the piston 320 down the annulus (and the pin 340 up the slot 50 to position P4) which can be done quickly as a result of the higher flow areas of the ports 312*p* and check valves 313. The sub 305 is then in the configuration shown in FIG. 21, with the reamer cutter 319 extended, and the circulation ports open. The sub 305 can be de-activated as previously described for other examples, recovering the cutter 319 back into the body of the tool under the force of the spring 317 as the piston 320 moves up the annulus. Therefore, the fourth example also allows the operator to manipulate the timing of the transition phase with more control. Other similar examples can be constructed which lack cutters and do not ream, but instead have expandable stabiliser elements, which maintain a predetermined radial clearance between the string and the inner surface of the wellbore.

FIGS. 23-26 show a reaming device incorporating a fifth example 401 of a control sub, with similar parts as previously described, which will be referred to with the same reference numbers, but increased by 100, and parts that are shared with earlier examples will not be described in detail here, but the reader is referred to the earlier examples for an illustration of the structure and function of the corresponding parts of this example. In the example of FIGS. 23-26, the piston 420, pin 440, slot 50, body 405, spring 407, collar 412, ports 411, 425 and 430 are all typically the same as previously described. The flow tube 410 has the same arrangement of small ports 416 with piston seals above and below the ring of small ports 416. The modified collar 412 has ports 412*p*, check valves 413 and bleed valves 414 as previously described for previous examples.

The fifth example differs from the fourth example in that the cutter 419 is hingedly attached to the body and moves radially outward from the body 405 by pivoting around the hinge axis when the actuator sleeve 415 moves down the bore of the sub 405*b*. The cutter 419 is urged by a retaining spring 417 as before, to return it to its starting position when cutting operations have concluded.

In operation, the application of pressure to the bore 405*b* drives the piston 420 down the annulus, moving the pin 440 up the slot from position P1 to P2. The device can cycle repeatedly between settings P1 and P2 as previously described, without switching from the loop to an elongated axial track. The annulus floods quickly due to the large bore ports 412 and the one way valves 413 do not substantially restrict flooding of the annulus so the piston moves down (and the pin moves up through the first track of the loop to position P2) relatively quickly to the piston position shown in FIG. 24.

The movement of the piston back up the annulus (and the downward movement of the pin back down the second (return) track of the loop is controlled via the small ports 416 and bleed valve 414 as previously described. When the uppermost piston seals pass the small ports 416, the pin has just moved past the Y-junction between the loop and the elongated axial track and is in the transition zone at P3, ready to transition from the loop into the elongated axial track. At this point the seals on the piston cover the small ports 416 denying fluid passage through the small ports 416, so that the fluid in the annulus can only escape through the small bore bleed valve 414 in the collar 412. The flow rate through the small bore bleed valve is much slower than the flow through the small bores 416 and the ports 412*p*, so the piston 420 moves slowly, and the pin remains in the transition zone P3 for a longer period, which can be adjusted by manipulating the pressure differential, and the setting of the bleed valve. The typical settings can allow the pin to remain in the transition zone of the second (return) track at position P3 for 15 seconds-2 minutes or longer. The pumps at surface can be stopped if desired, and changes to the string can be made as previously described. The annulus can be flooded through the check valves 413 and ports 412*p* to drive the piston 420 down the annulus (and the pin 440 up the slot 50 to position P4) which can be done quickly as a result of the higher flow areas of the ports 412*p* and check valves 413. The sub 405 is then in the configuration shown in FIG. 25, with the reamer cutter 419 extended, and the circulation ports open. The sub 405 can be de-activated as previously described for other examples, recovering the cutter 419 back into the body of the tool under the force of the spring 417 as the piston 420 moves up the annulus.

Figure 27:
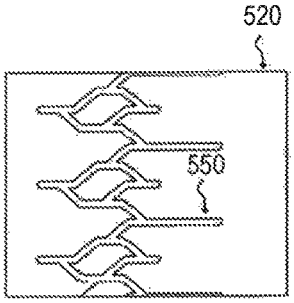
FIGS. 27-29 show three views of pistons similar to FIG. 8, showing alternative variants of slot used in different designs of pistons, usable in the FIG. 1 device.

Referring now to FIG. 27, an alternate design of piston 520 is shown in flat view similar to FIG. 8. The alternate design of piston 520 has a slot 550 which is effectively the mirror image of the slot 50 shown in FIG. 8, and which typically works in the same way as the piston 20 having the slot 50 as shown in FIG. 8, except that the pistons 20 and 520 rotate in opposite directions. Other functions of the piston 520 are the same as previously described for other examples. The piston 520 typically incorporates a separate sleeve that is provided with ports (not shown) similar to ports 25 provided in piston 20. Typically the piston 520 does not have any integral ports as a result.

Figure 28:
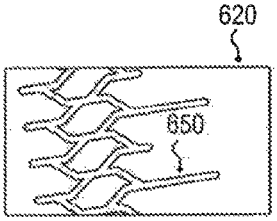
Figure 29:
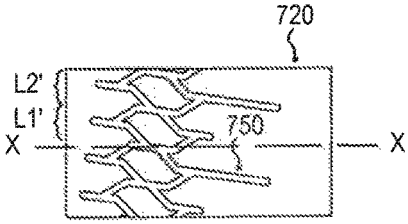

Referring now to FIG. 28 and FIG. 29, further alternative designs of piston 720 are disclosed having another variation of slot 750. The slot 750 has loops L1' (although it could have more than two loops as described for slot 650) and elongated axial tracks L2' in an interlacing arrangement. In the slot 750, the linear portions at the blind ends of the loops L1' and the elongated axial tracks L2' are non-parallel to the axis X-X of the piston 720, so that the whole of the slot 750 is deviated at an angle with respect to the axis X-X. The configurations of FIGS. 28 and 29 are mirrored images to each other. Therefore, travel of the pin in the slot 750 causes continual rotation of the piston, and the extent of rotation varies in accordance with the angle of deviation away from the axis X at each part of the slot 750. The linear blind ended portions of the slot 750 in loops L1' and the elongated axial tracks L2' are typically parallel to one another, although this is not necessary.

In a typical example, apparatus according to the invention that is incorporated into a control sub in a circulating string typically according to the first example can be operated as follows:

1. Prepare to run tool string into the hole, pumps at surface can be idle, pumping 0 GPM/0 PSI. Pin is typically held in position P1.

2. Run tools into the predrilled hole, while operating surface pumps at around 100 GPM, which typically corresponds to around 24 PSI at bit Pin moves to position P2.

3. Add subsequent sets of drill pipe at surface, while pumps idle pumping 0 GPM/0 PSI at bit. Pin moves from position P2 back to position P1 (passing through transition zone P3). Adding a set of drill pipe to the string can take approximately 2-5 minutes.

4. Continue steps 2 and 3 until tool string reaches required depth.

5. Drill with higher pressure from pumps at surface, typically around 300+GPM, corresponding to around 225 PSI at bit. Travel pin is moved into position P2, with circulation valve closed.

6. Add another set of drill pipe at surface, while pumps are idle, at 0 GPM, 0 PSI at bit. Travel pin moves from position P2 back to position P1 (passing transition zone 3) again adding set of drill pipe.

7. Continue steps 5 and 6 until required to activate presented tool e.g. circulation sub, under-reamer, stabiliser etc.

8. To activate tool by switching from a loop to an elongated axial track, increase flow rate at surface pumps to 100+GPM, moving the pin into position P2, corresponding to around 24+PSI at the bit, then reduce the flow rate to less than 60 GPM at surface, or around 9 PSI at the bit, or shut down surface pumps completely for approximately 20-50 seconds. Pin moves to transition zone (position P3). While the travel pin is crossing transition zone P3 start pumps again with 100+GPM, 24+PSI at the bit. This causes the pin to switch from the loop to the elongated axial track and move to position P4. In this position, the tool is activated. The circulation sub typically increases TFA, the under-reamer can typically extend the cutter face, and/or the stabiliser can typically extend stabilising pads.

9. To switch OFF the tool the same method is followed as per step 8. This time when pressure reduces, pin moves from position P4 to transition zone P5 and after increasing flow in the system the pin will move to position P2' which corresponds to position P2 above.

10. Tool can be activated and deactivated as many times as required using the method described in steps 8 and 9.

As mentioned in step 8, in order to activate the tool the pumps can be switched off for 20-50 seconds, but this can be adjusted for different periods of time. Also 60 GPM with 9 PSI can be adjusted if required. Pump rates and pressure values can be varied within the scope of the invention.

Embodiments permit the construction of tools that switch between high and low pressure (or on and off) where the pressure can be reduced (optionally to zero) for a particular time, after which the pressure can be increased or applied again with the tool in the active configuration. Other embodiments allow switching between high and low pressure where the pressure is reduced to a particular value that allows switching between the in-active loops and active elongated axial tracks.

The invention also provides a control slot for a pin and slot arrangement for a downhole controller, wherein the slot comprises at least one loop and at least one elongated axial track, the at least one loop being configured to cycle the tool between different inactive configurations, and the at least one elongated axial track being configured to place the tool in an active configuration.

Thus embodiments of the slot provide at least one loop in an OFF configuration and at least one elongated axial track in an ON configuration, and permit switching between the at least one loop and at least one elongated axial track.

Radial spacing of the P1, P2 and other positions in the profile can typically be varied within the scope of the invention. One profile might have positions P1 and P2 that are spaced circumferentially from position P4 by e.g. 180 degrees, but other examples might have different spacing and/or more or less pairs of loops. For example, there might be three pairs of loop and elongated axial track with equivalent positions spaced 60 degrees around the circumference of the piston. There might be a different numbers of profiles spaced with different angles.

In the examples disclosed, the positions P1 and P2 do not need to be in axial alignment with one another as shown in the examples. Position P1 can optionally be displaced around the circumference with respect to position P2 and the elongated axial tracks may also have two ends displaced around the circumference with respect to each other, which will change the shape of the profile but need not change functionality of the tool.

FIGS. 30-33 show a modified example of the control sub of FIGS. 16-18, with similar parts, which will be referred to with the same reference numbers, but starting with "8" instead of "2", and parts that are shared with the earlier examples will not be described in detail here, but the reader is referred to the earlier examples for an illustration of the structure and function of the corresponding parts of this example. In the present example of FIGS. 30-33, the piston 820, pin 840, spring 807, collar 812, small ports 816, port 812*p*, one way check valves 813, and bleed valve 814 are all typically the same as previously described, although in some versions, the slot 850 can typically have each loop and each elongated axial track formed with long slots at the upper end, instead of alternating short and long slots between the loops and the elongated axial tracks as shown in the drawings.

The body 805 is divided into a valve sub 805*v* secured by a pin and box arrangement below a piston sub 805*p*. The valve sub 805*v* carries a closure member in the form of a flap 819 that closes the bore 805*b* in a similar manner to the flap 219. The flap 819 is secured to the end of a valve tube 815, and moves with the valve tube 815. The valve tube 815 is mounted on the lower end of a valve piston 870, which is co-axially mounted on the outer surface of the flow tube 810, and can slide relative to the flow tube 810, which is fixed to the body, typically by means of the collar 812. Optionally the collar 812 can comprise an upper collar 812*u* and a lower collar 812*l*, spaced along the flow tube, and typically immovably connected to the body e.g. by welding, screw attachment, etc. The collars 812*u,l* typically centre the flow tube 810 in the bore 805*b* as well as fixed it axially to the body. The lower collar 812*l* typically acts as an end stop for the spring 807, which is compressed between the lower collar 812*l* and the lower end of the piston 810.

The ports 830 through the body are typically spaced away from the piston 850, and in this embodiment are provided on the valve sub 805*v*. The valve piston 870 typically carries the ports 825, and the ports 811 on the flow tube are also carried in the valve sub 805*v*. The valve piston 870 slides axially over the flow tube 810 to expose and cover the ports 811 and allow and deny communication through the ports 830. The valve piston 870 has a piston area having different sealed diameters so that when subjected to a pressure differential it moves down the bore 805*b* towards the flap 819. Also, the valve piston is pushed in the same direction by a very thin valve actuator sleeve 817 (best seen in FIG. 30*b*) which overlies the flow tube 810 and can slide down to push the upper end of the valve tube 816.

The present example also contains an optional mechanism to limit the travel of the spring when the piston has moved down the annulus, so that the pin essentially functions as a rotation controller, and bears less axial load when it approaches the ends of the slots, allowing the present example to be used in high pressure scenarios without overloading the pin.

The travel limiting mechanism comprises a pair of intercalating upper and lower sleeves 860*u* and 860*l* mounted on the piston 850 and the lower collar 812*l* respectively, which have opposed intercalating formations permit different extents of axial travel dependent on the relative rotations positions of the formations 860*u,l*. In the present example, the intercalating formations are provided by generally parallel sided fingers 861*u* and 861*l*, although the precise shape can vary in different embodiments. Because the lower sleeve 860*l* is fixed to the lower collar, which is fixed to the body, the lower fingers 861*l* do not rotate and do not translate axially. However, the upper sleeve 860*u* is fixed to the axially movable and rotatable piston 850, and so rotates and translates with the piston 850, relative to the static lower sleeve.

Figure 31B:
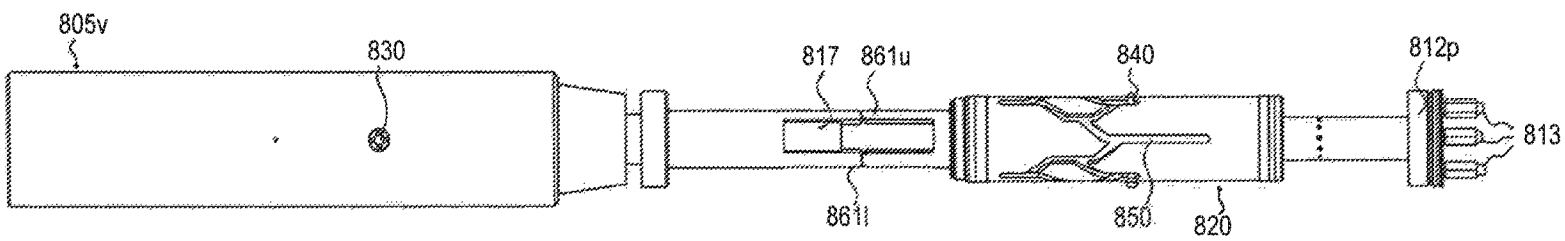
Figure 32B:
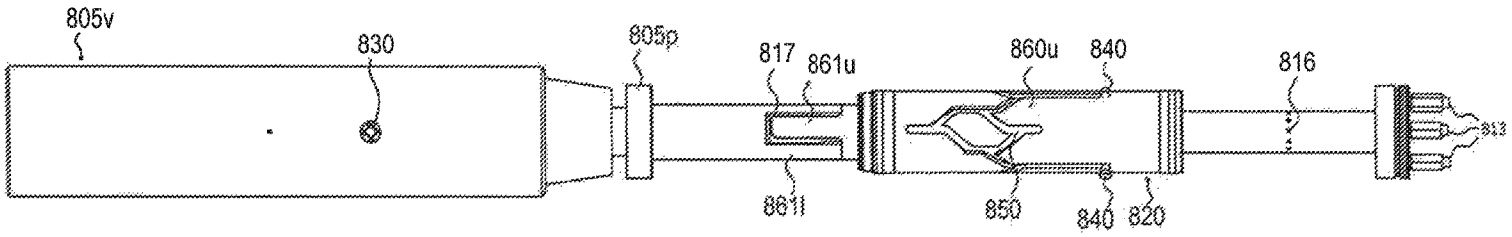
Figure 33B:
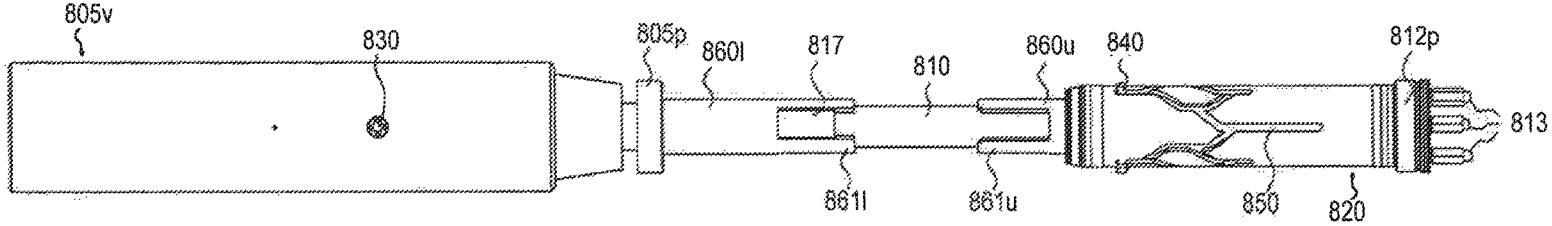

Thus the upper fingers can be circumferentially aligned with the lower fingers and spaced apart therefrom as shown in FIG. 30*b*, or circumferentially aligned and abutted against the lower fingers as shown in FIG. 31*b*, such that the ends of the fingers limit further axial travel, or circumferentially staggered and intercalated as shown in FIG. 32*b*, in which the maximum axial travel of the sleeves 860 has been achieved, or circumferentially staggered and axially spaced apart as shown in FIG. 33*b*. In the two middle positions, the maximum axial travel of the piston therefore depends on the relative rotational positions of the fingers 861 on the two sleeves. The relative rotational positions of the fingers when the sleeves 860 are spaced apart is not always significant; it is the abutment or intercalating of the fingers when the sleeves are pressed together that is typically important as it is this that allows or denies the additional axial travel that activates the device.

The operation of this example is otherwise similar to the FIG. 16 version; the application of pressure to the bore drives the piston 820 down the annulus, moving the pin 840 up the slot corresponding to previously described positions P1 and P2. The device can cycle repeatedly between settings P1 and P2 as previously described, without switching from the loop to an adjacent elongated axial track until the operator is ready. The annulus floods quickly due to the large bore ports 812*p* and the one way valves 813 do not substantially restrict flooding of the annulus so the piston moves down (and the pin moves up through the first track of the loop) relatively quickly to the position shown in FIG. 31. At this stage the fingers 861*u,l* are aligned and abut one another, which limits the extent of axial travel of the piston 820, typically before the pin 840 has reached the end of the short slot. This relieves the forces acting on the pin 840.

Optionally the piston can be formed with all upper slots having the same dimensions, and the limit of travel within the slot can be defined by the sleeves 860 alone.

The movement of the piston 820 back up the annulus (and the downward movement of the pin back down the second (return) track of the loop requires the fluid in the annulus above the piston to escape from the annulus before the piston 820 moves up. The fluid in the annulus cannot pass back through the check valves 813, and as before, the fluid in the annulus is routed into the bore 805*b* via the small ports 816. The combined flow area of the small ports is relatively large and the initial upward movement of the piston 820 is rapid as the fluid exhausts through the small ports 816. When the uppermost piston seals pass the small ports 816, the pin has just moved past the Y-junction between the loop and the elongated axial track and is in the transition zone, ready to transition (if desired) from the loop into the elongated axial track. At this point the seals on the piston cover the small ports 816 denying fluid passage through the small ports 816, so that the fluid in the annulus can only escape through the small bore bleed valve 814 in the collar 812. The flow rate through the small bore bleed valve is much slower than the flow through the small ports 816 and the ports 812*p*, so the piston 820 moves very slowly, and the pin remains in the transition zone for a longer period, which can be adjusted by manipulating the pressure differential, and the setting of the bleed valve. The typical settings can allow the pin to remain in the transition zone of the second (return) track for 15 seconds-2 minutes (for example) or longer. The pumps at surface can be stopped if desired, and changes to the string can be made as previously described. While the pin 840 is cycling in the (inactive) loop, the fingers are aligned as shown in FIGS. 30 and 31, and so the upper fingers 861*u* are always spaced from the valve actuator sleeve 817, so the valve is never actuated.

When the operator decides to switch tracks and activate the device, when the pin is in the transition zone, the annulus can be flooded once again through the check valves 813 and ports 812*p* to drive the piston 820 down the annulus (and the pin 840 up the slot 850) to the position shown in FIG. 32*b*, which is equivalent to position P4, which can be done quickly as a result of the higher flow areas of the ports 812*p* and check valves 813. Note that as a result of the rotation of the piston 820, the fingers 861*u* on the upper sleeve 860*u* are no longer aligned with the fingers 861*l* on the lower sleeve 860*l*, and so the two sets of fingers 861 can intercalate, allowing the upper pins 861*u* to engage the thin valve actuator sleeve 817, and push it down to the position shown in FIG. 32*b*. This slides the whole valve piston 870 and valve tube 815 down towards the flap 819, which compresses a spring urging the valve piston 870 up the bore towards the piston 820.

Thus, in the active position when pressure is applied, piston 820 moves the attached upper sleeve 860*u* down the outer surface of the flow tube. When the intercalating fingers on the upper sleeve slide in between the fingers on the lower sleeve 860*l*, they engage the upper end of the thin valve actuator sleeve 817 (underlying the lower sleeve 860*l*). The valve actuator sleeve is attached to the valve piston 870, and as it is pushed down the flow tube, this pushes the valve piston down the outer surface of the flow tube until a seal on the inner surface of the valve piston passes below the ports 811 on the flow tube, which admits the high fluid pressure pumped from the surface through the bore of the flow tube through the ports 811 and behind the sealed area of the valve piston 870. The outer surface of the valve piston 870 is also sealed against the inner surface of the valve sub 805*v*, and the opening of the ports 811 through the flow tube creates a differential across the different diameters of sealed inner and outer areas of the valve piston 870, which is thereby urged down the bore 805*b* against the force of a spring which is held in compression between a step on the valve piston 870 and a collar that is fixed to the valve body 805*v*. Under the force generated by the pressure differential the valve piston 870 moves down relative to and independently from the upper control piston 820, and has a stroke that is not limited to the stroke of the piston 820. When the force generated by the pressure differential reduces below the force of the compressed spring, the spring force returns the valve piston 870 to the initial position, with the ports 811 sealed. Optionally the upper control piston 820 could stop moving in the bore, and the valve piston 870 could travel alone to close the flap and align ports 830 and 825, although in some embodiments, both pistons will typically travel together providing more force to close the flap. The annulus (which is typically sealed) below the sealed area of the valve piston 870 is typically at ambient pressure, and typically has a small port through the wall of the valve sub 870 to connect the annular area to the exterior of the tool, which reduces the risk of hydraulic locking of the valve piston. When there is no pressure in the system, the valve piston 870 is typically in the closed position shown in FIG. 33*a*, with the spring expanded between the collar and the step on the valve piston 870, driving the valve piston 870 against an inner shoulder on the pin at the top of the valve sub 805*v* which acts as a piston stop.

Once the valve piston 870 has moved down enough to align the ports 825 on the valve piston 870 and the ports 811 on the flow tube, the force from the fluid pressure in the bore 805*b* is then transferred to the valve piston 870, and it is urged downwards in the valve sub 805*v* by the large force of the hydraulic pressure. Hence the initial motive force transferred by the actuator sleeve 817 to allow the fluid pressure to bear on the valve piston 870 can be relatively small and the associated components can be lighter and less complex. Also, the forces closing the valve can thereby be arranged to act directly on the valve piston allowing efficient force transfer and high closure forces. Typically a small port through the wall of the valve sub into the piston area reduces the risk of hydraulic locking of the valve piston 870.

The jetting ports 830 permit re-circulation of fluid from the bore 805*b* at high pressures, while the bore is closed below by means of the flap, thereby directing all of the bore fluid through the jetting ports. Spacing the jetting ports from the piston 820 means that the slot 850 can be sealed off from the high pressure fluids passing through the bore 805*b* and out of the jetting ports 830, and so there is less risk of debris entering the slot and restricting movement of the piston.

When the circulation operations are finished, the pumps are switched off at surface, and the valve piston 870 returns to the closed position shown in FIG. 30, under the force of a spring.

As before, the flap 819 only engages the funnel 818 when the pin moves into the elongated axial track and into position P4. Therefore, this example also allows the operator to manipulate the timing of the transition phase with more control, and can apply more of the wellbore pressure to the circulation ports 830 as a result of the closure of the bore 805*b* by the flap 819. Also, the piston 820 and slot 850 can be engineered to a lower level as their function can be focussed on controlling the operation rather than providing the motive force for operating the tool, but the device as a whole can be used in higher pressure applications as the high force aspects can be engineered into the valve piston which can be separated from the control piston 820.

The present arrangement also allows less engineering focus on the slot, which can typically have loops and elongated axial tracks interlacing in a repetitive pattern, but the behaviour of the pin in the slot can be governed by other factors such as the intercalating fingers below the piston.

It should be noted that the present example can operate tools other than valves (e.g. cutters, under-reamers etc. as shown in other examples herein), and different kinds of valves other than flap valves as shown, and the present embodiments are shown for example only.

FIGS. 34-42*b* show a modified example of the control sub of FIGS. 30-33, with similar parts, which will be referred to with the same reference numbers, but starting with "9" instead of "8", and parts that are common with the earlier examples will not be described in detail here, but the reader is referred to the earlier examples for an illustration of the structure and function of the corresponding parts of this example. In the present example of FIGS. 34-42*b*, the piston 920, pin 940, spring 907, collar 912, small ports 916, port 912*p*, flap 919, one way check valves 913, and bleed valve 914 are all typically the same as previously described. The pin 940 and slot 950 in this example are referred to as a primary control pin 940 and a primary control slot 950 respectively so that they are distinguishable from a secondary control pin 980 and a secondary control slot 990 which will be described in detail below.

The body 905 is divided into a valve sub 905*v* secured by a pin and box arrangement below a piston sub 905*p*. The valve sub 905*v* carries a closure member in the form of a flap 919 that closes the bore 905*b* in a similar manner to the flap 819. The flap 919 is secured to the end of a valve tube 915, and moves with the valve tube 915. The valve tube 915 is mounted on the lower end of a valve piston 970, which is co-axially mounted on the outer surface of the flow tube 910, and can slide relative to the flow tube 910, which is fixed to the body, typically by means of the collar 912. Optionally the collar 912 can comprise an upper collar 912*u* and a lower collar 912*l*, spaced along the flow tube, and typically immovably connected to the body e.g. by welding, screw attachment, etc. The collars 912*u,l* typically centre the flow tube 910 in the bore 905*b* as well as fixed it axially to the body. The lower collar 912*l* typically acts as an end stop for the spring 907, which is compressed between the lower collar 912*l* and the lower end of the piston 920.

The ports 930 through the body are typically spaced away from the piston 920, and in this embodiment are provided on the valve sub 905*v*. The valve piston 970 typically carries a seal 935 arranged to cover and uncover ports 911 on the flow tube, and the ports 911 on the flow tube 910 are also carried in the valve sub 905*v*. The valve piston 970 slides axially over the flow tube 910 to expose and cover the ports 911 and to allow and deny communication through the ports 930. The valve piston 970 has a piston area having different sealed diameters so that when subjected to a pressure differential it moves down the bore 905*b* towards the flap 919. Also, the valve piston 970 is pushed in the same direction by a very thin valve actuator sleeve 917 (similar to sleeve 817 in FIG. 30*b*) which overlies the flow tube 910 and can slide down to push the upper end of the valve tube 915.

The present example also contains an optional mechanism to limit the travel of the spring when the piston has moved down the annulus, so that the pin essentially functions as a rotation controller, and bears less axial load when it approaches the ends of the slots, allowing the present example to be used in high pressure scenarios without overloading the pin.

The travel limiting mechanism comprises a pair of intercalating upper and lower sleeves 960*u* and 960*l* mounted on the piston 920 and the lower collar 912*l* respectively, which have opposed intercalating formations permit different extents of axial travel dependent on the relative rotations positions of the formations 960*u,l*. In the present example, the intercalating formations are provided by generally parallel sided fingers 961*u* and 961*l*, although the precise shape can vary in different embodiments. Because the lower sleeve 960*l* is fixed to the lower collar, which is fixed to the body, the lower fingers 961*l* do not rotate and do not translate axially. However, the upper sleeve 960*u* is fixed to the axially movable and rotatable piston 920, and so rotates and translates with the piston 920, relative to the static lower sleeve.

Thus the upper fingers 961*u* can be circumferentially aligned with the lower fingers 961*l* and spaced apart therefrom similar to the embodiment shown in FIG. 30*b*, or circumferentially aligned and abutted against the lower fingers similar to the embodiment shown in FIG. 31*b* and as shown in FIG. 39, such that the ends of the fingers limit further axial travel, or circumferentially staggered and intercalated (similar to the embodiment shown in FIG. 32*b* and as shown in FIG. 40), in which the maximum axial travel of the sleeves 960 has been achieved, or circumferentially staggered and axially spaced apart (similar to the embodiment shown in FIG. 33*b*). In the two middle positions, the maximum axial travel of the piston therefore depends on the relative rotational positions of the fingers 961 on the two sleeves. The abutment or intercalating of the fingers when the sleeves are pressed together allows or denies the additional axial travel that activates the device.

The movement of the valve piston 970 within the bore 905*b* is regulated by a secondary pin and slot arrangement, constraining the extent of axial movement of the valve piston 970 within the bore 905*b*, and guiding rotation of the valve piston around its axis. The valve piston 970 is in the form of sleeve having an axial bore, and in this embodiment, a secondary control slot 990 is formed on the outer surface of the valve piston 970. The pin and slot arrangement is shown in FIG. 41. In this embodiment, a secondary control pin 980 is inserted through a threaded bore passing laterally through the side wall of the body 905*v*, and extends into the bore by a short distance, sufficient to engage the secondary control slot 990 and to retain the secondary control pin 980 within the secondary control slot 990 as the valve piston 970 moves up and down. The secondary control slot 990 is typically provided on the outer surface of the valve piston 970. In alternative examples, the secondary control slot 990 can be provided on a separate sleeve that can be separately connected to the valve piston 970, or alternatively the valve piston 970 can be provided with a secondary control pin, that extends laterally outwards into an inwardly facing slot provided on the inner surface of the bore, or on a separate sleeve connected with the bore.

The secondary control slot 990 on the valve piston 970 has at least one loop or closed path as shown in FIG. 41, allowing the secondary control pin 980 to move between a plurality of different configurations of the secondary control pin and slot. This loop is a closed path when viewed from a lateral direction of the valve piston 970, and is not a closed path when viewed from a longitudinal direction of the valve piston 970 or a closed path formed around a circumference of the valve piston 970.

The operation of this example is described in more detail below. The operation of the primary control pin 940 and primary control slot 950 is similar to the FIGS. 30-33 version. As is best seen with reference to FIG. 8 and FIG. 41, the primary control pin 940 starts at point P1 of the primary control slot 950 and the secondary control pin 980 starts at point Q1 of the secondary control slot 990, corresponding respectively to the positions of the primary control slot 950 and the secondary control slot 990 shown in FIG. 34.

As the application of pressure to the bore drives the piston 920 down the annulus as previously described, the piston 920 starts to move down relative to the stationary primary control pin 940, and the primary control pin 940 tracks axially up the blind end of the axial portion through deviated portions 1*d* and 1*d*' of the first track of the loop to position P2 shown in FIG. 8 as previously described, corresponding to the position of the primary control slot 950 shown in FIG. 35. At this stage the fingers 961*u,l* are aligned and abut one another as shown in FIG. 39, which limits the extent of axial travel of the piston 920, typically before the primary control pin 940 has reached the end of the short slot. This relieves the forces acting on the primary control pin 940. Optionally the piston can be formed with all upper slots having the same dimensions, and the limit of travel within the primary control slot can be defined by the sleeves 960 alone. As the fingers are aligned as shown in FIG. 39, the upper fingers 961*u* are always spaced from the valve actuator sleeve 917, so the valve piston 970 is never actuated and the secondary control pin 980 remains at point Q1 of the secondary control slot 990. In addition, in this configuration the flow tube ports 911 are covered by seal 935, disallowing fluid communication between flow tube ports 911 and the body ports 930, and fluid circulation cannot take place through the sidewall of the tool.

As fluid pressure is reduced in the bore 905*b*, for example by decreasing activity of the pumps on the surface, the force of the spring 907 eventually is able to overcome the fluid pressure and force the piston 920 back up the annulus, so that the primary control pin 940 begins to move down the primary control slot 950. Similar to the FIGS. 30-33 version, starting from position P2, the primary control pin 40 tracks down the blind ended axial slot, but does not enter the deviated section of the first track 1*d*', and instead enters the second (or return) track of the loop comprising deviated sections 2*d* and 2*d*' before eventually returning to point P1. The sub 1 can cycle repeatedly in this manner within the two tracks of the loop between P1 and P2 as many times as needed, without moving the secondary control pin 980, which remains at point Q1 of the secondary control slot 990, and without activating the downhole tool controlled by the sub 1.

When the sub is ready to open the circulation ports 930 and/or activate a tool controlled by the sub, the primary control pin 940 is cycled though the first track from position P1 to P2, and on the return or second track of the loop, the pin is switched from the loop to the elongated axial track. This is done by reversing the direction of movement of the sleeve/piston at some point in the transition area P3. The reversal of the direction of movement of the sleeve/piston is typically achieved by switching or adjusting the pumps at the surface, e.g. increasing their level of activity to increase fluid pressure and to cause the piston 920 to change axial direction within the annulus. Because of the geometry of the slot, when the primary control pin 940 is moving up the transitional portion P3, it is tracked into the elongated axial track, and does not return into the deviated part 2*d* of the loop. Accordingly, the primary control pin 940 tracks through a deviated section of the elongated axial track to position P4 at the end of the elongated axial track corresponding to the position of the primary control pin and slot configuration as shown in FIG. 36.

As a result of the rotation of the piston 920, the fingers 961*u* on the upper sleeve 960*u* are no longer aligned with the fingers 961*l* on the lower sleeve 960*l*, and so the two sets of fingers 961 can intercalate as shown in FIG. 40, allowing the upper pins 961*u* to engage the thin valve actuator sleeve 917, and push it down to a position similar to the configuration shown in FIG. 32*b*. This slides the whole valve piston 970 and valve tube 915 down towards the flap 919, which compresses a spring 927 urging the valve piston 970 up the bore towards the piston 920. In the meantime, due to the movement of the valve piston 970, the secondary control slot 990 on the valve piston 970 is forced to move relative to the secondary control pin 980 fixed on the inner surface of the sub.

A seal 935 (best seen in FIG. 42*b*) on the valve piston 970 covers flow tube ports 911 before the valve piston 970 moves towards the flap 919 as shown in FIG. 34 and FIG. 35 configurations. While the valve piston 970 moves towards the flap 919, the seal starts to uncover the ports 911, forming a cavity ww (best seen in FIG. 36) between the inner surface of the valve sub 905*v* and the outer surface of the flow tube 910. The length of this cavity ww along the length of the sub increases as the valve piston 970 moves further towards the flap 919. As the ports 911 are uncovered, fluid communication is allowed between ports 911 and cavity ww, causing fluid to flow from the flow tube 910 into the cavity ww. The fluid pressure in the cavity ww further pushes the valve piston 970 towards the flap 919. When the valve piston 970 moves to its FIG. 36 position, the cavity ww is in communication with both body ports 930 and flow tube ports 911, allowing fluid communication between the inner bore of the flow tube 910, through the flow tube ports 911, cavity ww, and through the body ports 930, to the outside of the tool as shown in FIG. 36. As the secondary control slot 990 in FIG. 41 starts to move down relative to the stationary secondary control pin 980, the secondary control pin 980 tracks axially up the end Q1 in FIG. 41 of the axial portion through deviated portions 1*e* and 2*e* of the loop to position Q2. In this example, the secondary control pin and slot activate circulation of fluid at point Q2.

In this example, the funnel 918 is coupled to valve sub 805*v* via a spring 922, urging the funnel 918 up the bore towards the valve piston 970. As before, the flap 919 engages the funnel 918 when the valve piston 970 pushes the flap 919 towards the funnel 918. After the flap 919 fully engages with the funnel 918, the valve piston 970 continues to move towards the funnel 918 and the spring 922 is compressed as shown in FIG. 36. This corresponds to the configuration in which the primary control pin 940 moves into the elongated axial track and into position P4 and the secondary control pin 980 moves to Q2. As before, this example also allows the operator to apply more of the wellbore pressure to the circulation ports 930 as a result of the closure of the bore 905*b* by the flap 919.

Optionally the flow tube ports 911 can also be circumferentially aligned with the body ports 930, but this is not essential. This permits fluid to be circulated from the bore 905*b* above the control sub through the ports 911 and 930, to the outside of the tool at high pressures, which is useful for keeping debris in circulation, thereby enabling them to be recovered back to the surface. Circulation continues on this way at high pressure allowing the circulation sub embodying the invention to maintain, for example, drill cuttings and other debris in the annulus between the outside of the body 905 and the inner surface of the wellbore in suspension and helping to wash it back to the surface.

When circulation operations have been completed, and the circulation is to be ceased, the pumps are switched off (or otherwise adjusted) at the surface and fluid pressure reduces to zero, and the force of the spring on the piston 920 becomes greater than fluid pressure force on the piston 920 and moves the piston 920 to the FIG. 37 position, by movement of the primary control pin 940 back along the elongated axial track away from point P4 in FIG. 8. There is a transition zone P5 between a second deviated branch 4*d* of the elongated axial track and the first track of the next loop, so when the primary control pin 940 reaches the end of the second deviated branch 4*d* of the elongated axial track, it enters the next loop and tracks to P1'. In the meantime, as a result of the spring 907 pushing the piston 920 away from the valve piston 970, the fingers 961*u* on the upper sleeve 960*u* are no longer pushing against the thin valve actuator sleeve 917, allowing the thin valve actuator sleeve 917 and the valve piston 970 to move up under the force of a retaining spring to the position shown in FIG. 37. Consequently, the secondary control slot 990 on the valve piston 970 starts to move up relative to the stationary secondary control pin 980, and the secondary control pin 980 tracks axially down the first extreme point Q2 through deviated portion 3*e* of the loop to a blind end position Q3 in FIG. 41. When the valve piston 970 moves to its FIG. 37 position, the cavity ww is no longer in fluid communication with both body ports 930, prohibiting fluid communication between the inner bore of the flow tube and the outside of the tool.

As the valve piston 970 moves up towards piston 920, the spring 922 extends and urges the funnel 918 back towards the valve piston 970, maintaining the engagement between the flap 919 and the funnel 918 when the secondary control pin 980 moves from position Q2 to Q3. The distance between Q1 and Q3 is also long enough for the flap 919 to remain engaged with the funnel 918 while the secondary control pin 980 moves from position Q2 to Q3.

Therefore, when the primary control pin 940 tracks from P4 to P1' and the secondary control pin 980 tracks from Q2 to Q3, the flap 919 remains engaged with the funnel 918. When the primary control pin 940 is at P1' and the secondary control pin 980 is at Q3, there is no fluid pressure in the system. However, the valve piston 970 is able to respond to pressure increase as the flap 919 remains engaged with the funnel 918 and fluid pressure can be transmitted from flow tube port 911 to the cavity ww, where the pressure can act on the valve piston 970.

When the fluid pressure is increased again by the operator increasing activity of the pump, the piston 920 is pushed towards the flap 919, moving the primary control pin 940 from P1' to P2'. As a result of the rotation of the piston 920, the upper pins 961*u* engage the thin valve actuator sleeve 917, and push it down to a position to the configuration shown in FIG. 40 and consequently pushing the valve piston 970 towards the flap 919 and moving the secondary control pin 980 from Q3 to Q4. The valve piston 970 is also pushed by fluid pressure in the cavity ww. This results in a configuration shown in FIG. 38. The cavity ww is then in communication with both body ports 930 and flow tube ports 911, allowing fluid communication between the inner bore of the flow tube, through the flow tube ports 911, cavity ww, and through the body ports 930, to the outside of the tool as shown in FIG. 38. The flap 919 remains engaged with the funnel 918 in the transition from the FIG. 37 configuration to the FIG. 38 configuration.

Reducing the fluid pressure again by reducing activity of the pump on the surface will allow the piston 920 and the valve piston 970 to be pushed back by their respective springs urging against them, moving the primary control pin 940 from P2' to P1' and moving the secondary control pin 980 from Q4 to Q5. This results in the sub transforming from the FIG. 38 configuration back to the FIG. 37 configuration, in which the cavity ww is again no longer in communication with both body ports 930, prohibiting fluid communication between the inner bore of the flow tube and the outside of the tool. During this transition, the flap 919 remains engaged with the funnel 918. Subsequent increase of the fluid pressure will move the primary control pin 940 from P1' to P2' and move the secondary control pin 980 from Q5 to Q6. The operation of the sub when the secondary control pin 980 is at Q6 is similar to the above described operation when the pin is at Q4.

When the operations are finished, the pumps are switched off at surface, and the main piston 920 and the valve piston 970 return to their respective initial positions shown in FIG. 34, under the force of springs. Accordingly, the primary control pin 940 returns to P1' and the secondary control pin 980 returns to the inactive position Q1 in FIG. 41. This results in the sub transforming back to FIG. 34 configuration, in which the flap 919 disengages with the funnel 918.

Therefore, when the secondary control pin 980 are at positions Q2, Q4 and Q6, the tool is fully active, allowing fluid to be circulated from the bore 905*b* above the control sub through the flow tube, via ports 911, cavity ww and body ports 930, to the outside of the tool at high pressures, which is useful for keeping debris in circulation, thereby enabling them to be recovered back to the surface. When the secondary control pin 980 is at positions Q3 and Q5, there is no fluid communication between the flow tube and the outside of the tool as cavity ww is not in fluid communication with body ports 930 as shown in FIG. 38.

As explained above, circulating the primary control pin 940 between P1' and P2' results in the secondary control pin 980 moving from Q3, to Q4, to Q5 then to Q6. There could be more tracks copying the track section Q3-Q4-Q5 in the secondary control slot of FIG. 41 and extending the pattern. The extended pattern can be used to activate the tool more than three times in each cycle of slot of FIG. 41.

It is possible for active positions Q2, Q4 and Q6 to correspond to activation of different tools or different configuration of a tool. For example, the first fully active position Q2 in the secondary control slot 990 may be used to fully activate a circulation sub. The second fully active position Q4 in this slot 990 may be used to fully open cutter arms, i.e. open the cutter arms for a large radial displacement. The second partially active position Q5 may also open the cutter arms, but for a smaller radial displacement. The third fully active position Q6 in the secondary control slot 990 may be used for activating a reamer. In another possible application of the FIG. 41 arrangement, it could be used to control a combined reamer and circulation sub, in which the position Q2 could be used to activate the reamer only, the position Q4 could be used to activate the circulation sub only, and the third position Q6 could be used to activate both the reamer and the circulation sub.

One advantage of certain embodiments over J-slot and dropped ball alternative, is that the device can be reversibly activated and de-activated within a short period of time, e.g. within 1 minute. The device can be arranged to cycle between inactive configurations, without changing the cycle until the unique procedure of switching from a loop to an adjacent elongated axial track is initiated by choice of the operator. Therefore, when the operator stops the surface pumps to add another set of drill pipe, the device will typically stay in same (inactive) loop. When the operator increases the flow rate again, the device will typically cycle back within the same loop, without changing the configuration of the device being controlled.

The invention claimed is:

1. An apparatus for controlling a downhole device in an oil, gas or water well, the apparatus comprising a body having a control slot engaging a pin, the control slot and the pin being provided on separate parts that are movable relative to one another, such that movement of the pin relative to the control slot switches the downhole device between active and inactive states, the slot having at least one loop having a blind ended axial portion wherein the pin can move between different idling configurations of the pin and slot in which the device is inactive, and at least one elongated axial track arranged in the axial direction of the body and having a length in the axial direction longer than the blind ended axial portion, wherein the pin can move in the at least one elongated axial track between different configurations of the pin and slot which correspond to active and inactive configurations of the downhole device, wherein each of the at least one elongated axial track is connected to one of the at least one loop via a deviate branch track, which is configured to track the pin from one of the at least one elongated axial track into one of the at least one loop, wherein the control slot has no separate, dedicate return path for returning the pin from the deviate branch track to the elongated axial track, wherein the pin can be switched between each of the at least one elongated track and one of the at least one loop, and wherein the pin can cycle between the different configurations within each one of the at least one loops without switching from said loop to an adjacent elongated axial track.

2. The apparatus according to claim 1, wherein the pin can cycle repeatedly between the two different configurations of the pin and slot in each loop until switched from the loop to an adjacent elongated axial track.

3. The apparatus according to claim 1, wherein each loop comprises a first track and a second track, wherein the second track returns the pin to the starting point of the first track.

4. The apparatus according to claim 3, wherein the body has an axis, and wherein the pin moves in opposite directions in the two tracks with respect to the axis of the body.

5. The apparatus according to claim 3, wherein the pin can be switched from each one of the at least one loop to an adjacent elongated axial track on the second return track of said loop.

6. The apparatus according to claim 3, wherein the pin is switched from one of the at least one loop to one of the at least one elongated axial track by reversing the relative axial direction of movement of the pin and slot.

7. The apparatus according to claim 3, wherein each of the at least one loop has a transition portion adapted to switch the pin from the loop to an adjacent elongated axial track in the transition portion, wherein the transition portion is provided in the second return track of the loop.

8. The apparatus according to claim 7, wherein the junction is a Y-junction, and the switching from said loop to said the adjacent elongated axial track is accomplished by reversing the direction of movement of the pin relative to the slot when the pin is in the combined trunk of the y, heading away from the junction between the connecting upper limbs of the y, and wherein the one limb of the y junction comprises a part of said loop.

9. The apparatus according to claim 3, wherein the first and second tracks have linear portions and deviated portions and wherein the deviated portions drive relative rotation of the pin and slot with a greater rotational component than the linear portions.

10. The apparatus according to claim 9, wherein both the linear and deviated portions drive relative rotation of the pin and slot.

11. The apparatus according to claim 3, wherein the speed of movement of the pin in the first track is configured to be different from the speed of the pin in the second track.

12. The apparatus according to claim 11, wherein the pin is configured to move more slowly in the second track of the slot than in the first track.

13. The apparatus according to claim 11, wherein the difference in speed between the two tracks is controlled by hydraulic means.

14. The apparatus according to claim 1, comprising a piston responsive to pressure changes in the well, and axially movable in a bore in the apparatus in response to said pressure changes, and wherein the axial movement of the piston in the bore drives the relative movement of the pin and the slot.

15. The apparatus according to claim 14, wherein the slot is provided on the piston.

16. The apparatus according to claim 1, having multiple pairs of loop and elongated axial track, alternating in a sequence between each pair.

17. The apparatus according to claim 1, having more than two pairs of loop and elongated axial track, and wherein the pin can cycle from first pair to second pair to third pair or subsequent further pairs before returning to the first pair and repeating the cycle.

18. The apparatus according to claim 17, wherein different loops of the two pairs of loop and elongated axial track allow the pin to travel to different configurations of the pin and slot that switch the device between different states.

19. The apparatus according to claim 1, wherein each of the at least one elongated axial track is connected to one of the at least one loop via a second, different deviate branch track, which is configured to track the pin from said one of the at least one loop to said one of the at least one elongated axial track, and wherein any of the at least one elongated axial track does not form part of the at least one loop.

20. The apparatus according to claim 1, the apparatus further comprising a second body having an secondary control slot configured to engage with an secondary control pin, the secondary control slot and the secondary control pin being provided on separate parts that are movable relative to each other and the secondary control slot having at least one secondary control loop, such that movement of the secondary control pin relative to the secondary control slot within the secondary control loop switches the downhole device among a plurality of different states corresponding to different configurations of the secondary control pin and slot.

21. The apparatus according to claim 20, wherein the secondary control pin can cycle from a first stable position in the at least one secondary control loop to a second stable position in said loop to a third or subsequent stable position in said loop, before returning to the first position and repeating the cycle, and wherein the secondary control pin moving from one stable position to a subsequent stable position is initiated by reversing the relative axial direction of movement of the secondary control pin and secondary control slot.

22. The apparatus according to claim 20, comprising first and second pistons, wherein the first piston carries the primary control slot, and the second piston carries the secondary control slot and is movable in the body relative to the first piston in response to fluid pressure to drive the operation of the downhole device.

23. The apparatus according to claim 20, wherein the first and second configurations of the primary control pin and primary control slot correspond to different rotational orientations of the primary control pin and the primary control slot.

24. The apparatus according to claim 20, wherein the downhole device comprises a valve, a cutting tool, or a stabiliser, activated by a respective configuration between the secondary control pin and the secondary control slot.

25. The apparatus according to claim 20, wherein the body has an elongate shape, and the at least one secondary control loop is a closed path when viewed from a lateral direction of the body, and is not a closed path formed around a circumference of the body.

26. A method of controlling a downhole device in an oil, gas or water well, the method comprising providing an apparatus comprising a body having a control slot and a pin on separate relatively movable components so that the slot engages the pin and the pin and slot are configured to be movable relative to one another, and moving the pin relative to the slot to switch the downhole device between active and inactive states, wherein the method comprises moving the pin in at least one loop of the slot wherein the at least one loop had a blind ended axial portion and defines different idling configurations of the pin and slot in which the device is inactive, and moving the pin in at least one elongated axial track of the slot, wherein the at least one elongated axial track of the slot is arranged in the axial direction of the body and has a length in the axial direction longer than the blind ended axial portion, wherein the at least one elongated axial track defines different configurations of the pin and slot which correspond to active and inactive configurations of the downhole device, wherein the method comprises moving the pin from one of the at least one elongated axial track to one of the at least one loop via a deviate branch track, wherein the slot has no separate, dedicate return path for returning the pin from the deviate branch track to the elongated axial track, and wherein the method includes cycling the pin between the different configurations within the at least one loop without switching the pin from the at least one loop to one of the at least one elongated axial track.

27. The method according to claim 26, wherein the downhole device is switched from an inactive configuration to an active configuration by a) increasing fluid flow from pumps to move the pin into one end of one of the at least one loop;

b) moving the pin into a transition zone in preparation for switching the pin from said loop to one of the at least one elongated axial track by decreasing fluid flow from pumps for a designated time, and c) increasing the fluid flow from the pumps when the pin is in the transition zone to move the pin into said elongated axial track, thereby activating the downhole device.

28. The method according to claim 27, wherein in step a) the pumps are switched from off to on; in step b) the pumps are switched from on to off; and in step c) the pumps are switched from off to on.

29. The method according to claim 26, wherein in step a) the pumps are increased to more than 10% of their normal operating state; in step b) the pumps are reduced below 10% of their normal operating state; and in step c) the pumps are increased to more than 10% of their normal operating state.

30. The method according to claim 26, including cycling the pin repeatedly between the two different configurations of the pin and slot until the pin is switched from one of the at least one loop to one of the at least one elongated axial track.

31. The method according to claim 26, including switching the pin from one of the at least one loop to one of the at least one elongated axial track by reversing the relative axial direction of movement of the pin and slot.

32. The method according to claim 26, wherein one of the at least one loop has a transition portion adapted to switch the pin from the loop to one of the at least one elongated axial track in the transition portion, wherein the transition portion incorporates a Y-junction leading between the loop and the elongated axial track, and wherein the method includes switching from the loop to the elongated axial track by reversing the direction of movement of the pin relative to the slot when the pin is in the combined trunk of the Y, heading away from the junction between connecting limbs of the Y, and wherein one limb of the Y junction comprise a part of the loop.

33. The method according to claim 26, wherein one of the at least one loop has a first track and a second track returning the pin towards the starting point of the first track and wherein the method includes moving the pin at different speeds in the first and second tracks.

34. The method according to claim 33, including moving the pin more slowly in the second track of the slot than in the first track.

35. The method according to claim 26, including providing a piston responsive to pressure changes in the well, and moving the piston axially in a bore in response to said pressure changes, whereby axial movement of the piston drives the relative movement of the pin and the slot.

36. The method according to claim 26, including providing multiple pairs of loop and elongated axial track, and moving the pin sequentially between each pair.

37. The method according to claim 26, further comprising moving the pin from one of the at least one loop to one of the at least one elongated axial track via a second, different deviate branch track.

38. The method according to claim 26, the method further comprising providing the apparatus with a second body having an secondary control slot configured to engage with an secondary control pin, the secondary control slot and the secondary control pin being provided on separate parts that are movable relative to each other and cycling the secondary control pin within the secondary control slot to switch the downhole device among a plurality of different states corresponding to different configurations of the secondary control pin and slot.

39. The method according to claim 38, including providing first and second pistons, wherein the first piston carries the primary control slot, and the second piston carries the secondary control slot and is movable in the body relative to the first piston in response to fluid pressure and including using the second piston to drive the operation of the downhole device.

40. The method according to claim 38, including moving between the first and second configurations of the primary control pin and slot by changing the rotational orientation of the primary control slot relative to the primary control pin.

* * * * *